US011260264B2

(12) United States Patent
Richter

(10) Patent No.: US 11,260,264 B2
(45) Date of Patent: Mar. 1, 2022

(54) HAND SUPPORT APPARATUS, SYSTEM, AND METHOD OF USE FOR ENHANCING UPPER BODY EXERCISE

(71) Applicant: Elliott Allen Richter, Durham, NC (US)

(72) Inventor: Elliott Allen Richter, Durham, NC (US)

( * ) Notice: Subject to any disclaimer, the term of this patent is extended or adjusted under 35 U.S.C. 154(b) by 0 days.

(21) Appl. No.: 17/070,879

(22) Filed: Oct. 14, 2020

(65) Prior Publication Data

US 2021/0023415 A1 Jan. 28, 2021

Related U.S. Application Data

(63) Continuation of application No. 15/488,807, filed on Apr. 17, 2017, now abandoned.

(60) Provisional application No. 62/323,865, filed on Apr. 18, 2016.

(51) Int. Cl.

| | |
|---|---|
| ***A63B 21/00*** | (2006.01) |
| ***A63B 21/22*** | (2006.01) |
| ***A63B 23/12*** | (2006.01) |

(52) U.S. Cl.

CPC .... *A63B 21/4039* (2015.10); *A63B 21/00061* (2013.01); *A63B 21/00185* (2013.01); *A63B 21/22* (2013.01); *A63B 21/4021* (2015.10); *A63B 21/4035* (2015.10); *A63B 23/1227* (2013.01); *A63B 2209/00* (2013.01)

(58) Field of Classification Search

CPC ..... A63B 21/4039; A63B 23/1227; A63B 21/00185; A63B 21/4021; A63B 21/4035; A63B 21/00061; A63B 21/22; A63B 2209/00; A63B 22/20; A63B 23/0211; A63B 2225/09; A63B 21/0618; A63B 21/00047; A63B 21/068; A63B 21/4019; A63B 23/03541; A63B 23/1272; A63B 2208/0219; A63B 21/072

See application file for complete search history.

(56) References Cited

U.S. PATENT DOCUMENTS

| | | | | |
|---|---|---|---|---|
| 4,116,233 A * | 9/1978 | Scaduto | ..... | A61H 15/0092 601/113 |
| 5,302,165 A * | 4/1994 | Caruthers | ..... | A63B 21/0605 482/108 |
| 5,496,244 A * | 3/1996 | Caruthers | ..... | A63B 21/0605 482/108 |

(Continued)

*Primary Examiner* — Garrett K Atkinson

(57) ABSTRACT

Apparatuses, systems, and methods of use are disclosed for enhancing upper body exercise. An apparatus includes a domed hand support section, the domed hand support section having a plurality of recesses configured to receive a palm, thumb, and fingers of a user's hand while the user's hand is held in a naturally curved open-position. The apparatus also includes a surface engagement section secured to an underside of the domed hand support section and configured to engage a supporting surface. When the surface engagement section is deployed on the supporting surface and the palm, thumb, and fingers of the user's hand are placed in the plurality recesses on the domed hand support section, the domed face supports the user's hand in the naturally curved open position while the user exerts force against the domed hand support section and that is at least partially directed toward the supporting surface.

20 Claims, 15 Drawing Sheets

(56) References Cited

U.S. PATENT DOCUMENTS 5,607,380 A * 3/1997 Duty ..... A63B 21/00047 482/141
6,026,982 A * 2/2000 Caruthers ..... A47G 19/22 220/737
6,093,159 A * 7/2000 Racoosin ..... A61H 15/0092 601/118
6,942,605 B1 * 9/2005 Sukhovitsky ..... A63B 21/0004 2/24
7,063,646 B1 * 6/2006 Slimi ..... A63B 22/14 482/141
7,481,753 B2 * 1/2009 James ..... A63B 23/12 482/140
7,621,858 B2 * 11/2009 Sheron ..... A63B 21/0618 482/129
7,645,218 B2 * 1/2010 Potok ..... A63B 21/4035 482/141
8,382,645 B2 * 2/2013 Mylrea ..... A63B 21/4035 482/51
8,454,483 B1 * 6/2013 Bradley ..... A63B 21/072 482/92
8,460,160 B2 * 6/2013 Andrews ..... A63B 21/4001 482/49
8,814,768 B1 * 8/2014 Yang ..... A63B 23/1236 482/147
8,998,783 B2 * 4/2015 Orenstein ..... A63B 21/00047 482/141
9,011,294 B2 * 4/2015 Mylrea ..... A63B 21/4034 482/51
D731,004 S * 6/2015 Estrada, Jr. ..... D21/662
9,056,222 B2 * 6/2015 Thomason ..... A63B 23/1236
9,079,092 B2 * 7/2015 Stack ..... A63B 71/145
9,314,662 B1 * 4/2016 Willison ..... A63B 21/00047
9,579,533 B2 * 2/2017 Holland ..... A63B 5/20
9,750,975 B2 * 9/2017 Hunter, Jr. ..... A63B 21/068
9,943,726 B2 * 4/2018 Tilson ..... A63B 31/10
D822,221 S * 7/2018 Huth ..... D24/211
2006/0014615 A1 * 1/2006 Godbold ..... A63B 23/12 482/141
2006/0089241 A1 * 4/2006 Klein ..... A63B 21/00047 482/141
2007/0117695 A1 * 5/2007 Endelman ..... A63B 21/00047 482/140
2007/0287605 A1 * 12/2007 Mylrea ..... A63B 21/068 482/92
2008/0165123 A1 * 7/2008 Segalle ..... G06F 3/03543 345/156
2009/0209373 A1 * 8/2009 Brodmann ..... A63B 59/40 473/526
2010/0248920 A1 * 9/2010 Morales ..... A63B 21/00047 482/141
2012/0214653 A1 * 8/2012 Tsou ..... A63B 21/00047 482/142
2012/0309595 A1 * 12/2012 Dike ..... A63B 23/03525 482/93
2013/0213408 A1 * 8/2013 Andrews ..... A63B 71/14 128/846
2013/0252791 A1 * 9/2013 Chang ..... A63B 23/1209 482/132
2013/0274078 A1 * 10/2013 Andrews ..... A63B 21/4035 482/141
2013/0316886 A1 * 11/2013 Lynch ..... A63B 21/4035 482/146
2013/0324382 A1 * 12/2013 Wilson ..... A63B 23/0211 482/142
2014/0135189 A1 * 5/2014 Thomason ..... A63B 23/1236 482/141
2014/0194265 A1 * 7/2014 Torres ..... A63B 23/02 482/141
2014/0342887 A1 * 11/2014 Dike ..... A63B 22/16 482/139
2015/0072842 A1 * 3/2015 Segal ..... A63B 23/03533 482/141
2015/0190668 A1 * 7/2015 Ferdinandsen, II . A63B 21/012 482/93
2016/0000637 A1 * 1/2016 Shakarian ..... A61H 1/008 601/138
2016/0067551 A1 * 3/2016 Tilson ..... A63B 31/10 482/55
2017/0231851 A1 * 8/2017 Faussett ..... A61H 15/00 601/135

* cited by examiner

HAND SUPPORT APPARATUS, SYSTEM, AND METHOD OF USE FOR ENHANCING UPPER BODY EXERCISE

PRIORITY CLAIM

The present application claims the priority and benefit of U.S. Provisional Patent Application Ser. No. 62/323,865 entitled "HAND SUPPORT APPARATUS, SYSTEM, AND METHOD OF USE FOR ENHANCING UPPER BODY EXERCISE," filed on Apr. 18, 2016, and U.S. patent application Ser. No. 15/488,807 filed on Apr. 17, 2007, which also claims priority to the aforementioned U.S. Provisional Patent Application.

BACKGROUND

People spend a great deal of money on bulky upper body fitness machines, weight benches, and barbells, or continually pay for fitness club memberships to use such equipment. However, much of the benefit that can be gained from using such devices can be achieved by doing push-ups: resting the palms of one's hands and toes or knees on the floor and lifting one's body up and down to directly work the arm, shoulder, and chest muscles, while also indirectly working abdominal, back, neck, and other muscles.

However, all the force is necessarily directed through the person's hands and wrists, and, thus, can painfully overuse some muscles. Splaying out one's fingers and palm, and then repeatedly pressing a significant portion of one's body weight against one's hands, can strain the base of the palm, thumb, and fingers; pronating one's wrists can painfully strain one's wrists and forearms. Also, performing push-ups on a hard floor may be hard on the surfaces of the person's palm, thumb, and fingers. While one can perform push-ups with one's hands balled into fists, many find this too painful on the knuckles. Further, while holding one's hands in fists alleviates the wrist pain caused by pronating one's wrists against the ground, this position forces different strains on the wrist by requiring the user to balance on his or her fists to maintain his or her wrists in an upright position. Unfortunately, if the user fails to maintain his or her wrists in an upright position and rolls his or her wrists, serious wrist and arm injuries may result.

In an attempt to facilitate reaping the benefits of push-ups without straining the hands, fingers, and wrist, various devices have been created. Standard push-up handles have a base that rests on the floor with an upraised handle that extends parallel to the ground. Using such push-up handles, instead of the user splaying out his or her hands on the ground, the user grips the handles the way that one would use a barbell and lifts his or her body off the ground. The push-up handles may alleviate strain caused by splaying one's fingers and remove the strain caused by pronating one's wrist. On the other hand, use of the push-up handles still places strain on the wrists by requiring the user to hold his or her wrists in an upright position, and gripping the handles may still be uncomfortable for the user.

Conventional push-up handles are stationary devices and, thus, only facilitate standard up-and-down push-ups. Other floor-based exercise devices enable users to lift their bodies and slide their hands laterally to their bodies to work additional muscles. Some such devices include a reduced-friction sliding board and require the user to wear slideable mitts or gloves. However, such devices not only involve the user splaying out the fingers and pronating the wrists, but also involve somewhat narrow boards that limit the scope of movement. Other devices include a rigid, space-consuming base that supports slideable handles. While these devices eliminate splaying the fingers and pronating the wrists, they have a strictly restricted range of movement, still involve gripping handles, and consume space. Ab wheels allow a user to work other muscles by extending the arms upwardly from the shoulder. Nonetheless, such rolling devices still require tightly gripping the handles and do not provide the benefits of exercises that involve lateral movement.

People also may benefit from upper body exercises, such as curls and lateral raises, that may be performed with dumbbells or kettle bells. However, as users develop different muscles, they will need multiple sets of dumbbells or kettle bells of various weights which both consume storage space and require the user to drag out each of the weights to exercise. Alternatively, a user may have a set of dumbbell handles with removable plates that allow the user to adjust the weight of the dumbbells. Unfortunately, the user still has to drag out pairs of various weight plates, and also has to remove or install weight plates at both ends of each dumbbell to adjust the weights, which may be inconvenient.

It thus would be a significant advance in the art to provide a fitness aid that facilitates upper body exercise without undesirable muscle strains that result from push-ups with or without handle-based devices, that permit a full range of movement, and that do not consume much storage space. It would also be beneficial to provide the capability of dumbbells or kettle bells without the need for multiple dumbbells, kettle bells, or pairs of weight plates.

SUMMARY

Apparatuses, systems, and methods of use are disclosed for enhancing upper body exercise. An apparatus includes a domed hand support section. The domed hand support section has a plurality of recesses configured to receive a palm, thumb, and fingers of a user's hand while the user's hand is held in a naturally curved open-position. The apparatus also includes a surface engagement section secured to an underside of the domed hand support section and configured to engage a supporting surface. When the surface engagement section is deployed on the supporting surface and the palm, thumb, and fingers of the user's hand are placed in the plurality recesses on the domed hand support section, the domed face supports the user's hand in the naturally curved open position while the user exerts force against the domed hand support section and that is at least partially directed toward the supporting surface.

In another embodiment, an apparatus includes a domed hand support section. The domed hand support section has a plurality of recesses configured to receive a palm, thumb, and fingers of a user's hand while the user's hand is held in a naturally curved open-position. The apparatus further includes a wrist brace extending outwardly from the domed hand support section proximate an edge of the recess configured to receive the palm of the user. As a result, while the user exerts force against the domed hand support section, the wrist brace supportively engages an underside of a wrist of the user. The apparatus also includes a surface engagement section secured to an underside of the domed hand support section and configured to engage a supporting surface. When the surface engagement section is deployed on the supporting surface and the palm, thumb, and fingers of the user's hand are placed in the plurality recesses on the domed hand support section, the domed face supports the user's hand in the naturally curved open position while the user exerts force against the domed hand support section and that is at least partially directed toward the supporting surface.

In a further embodiment, an apparatus includes a domed hand support section. The domed hand support section has a plurality of recesses configured to receive a palm, thumb, and fingers of a user's hand while the user's hand is held in a naturally curved open-position. The apparatus further includes a strap configured to extend across the recess configured to receive the palm of the user's hand and to maintain the palm of the user's hand within the recess configured to receive the palm. The apparatus also includes a surface engagement section secured to an underside of the domed hand support section and configured to engage a supporting surface. When the surface engagement section is deployed on the supporting surface and the palm, thumb, and fingers of the user's hand are placed in the plurality recesses on the domed hand support section, the domed face supports the user's hand in the naturally curved open position while the user exerts force against the domed hand support section and that is at least partially directed toward the supporting surface.

In a still further embodiment, an apparatus includes a domed hand support section. The domed hand support section having a plurality of recesses configured to receive a palm, thumb, and fingers of a user's hand while the user's hand is held in a naturally curved open-position. The apparatus also includes a wrist brace extending outwardly from the domed hand support section proximate an edge of the recess configured to receive the palm of the user. As a result, while the user exerts force against the domed hand support section, the wrist brace supportively engages an underside of a wrist of the user. The apparatus further includes a strap configured to extend across the recess configured to receive the palm of the user's hand and to maintain the palm of the user's hand within the recess configured to receive the palm. The apparatus also includes a surface engagement section secured to an underside of the domed hand support section and configured to engage a supporting surface. When the surface engagement section is deployed on the supporting surface and the palm, thumb, and fingers of the user's hand are placed in the plurality recesses on the domed hand support section, the domed face supports the user's hand in the naturally curved open position while the user exerts force against the domed hand support section and that is at least partially directed toward the supporting surface.

Another embodiment includes a system configured to assist a user in performing physical exercise. The apparatus includes a domed hand support section. The domed hand support section has a plurality of recesses configured to receive a palm, thumb, and fingers of a user's hand while the user's hand is held in a naturally curved open-position. The system additionally includes a strap configured to extend across the recess configured to receive the palm of the user's hand and to maintain the palm of the user's hand within the recess configured to receive the palm. The system also includes a surface engagement system securable to an underside of the domed hand support section and configured to engage a supporting surface, the surface engagement system including a plurality of interchangeable weighted members. When the surface engagement system is deployed on the supporting surface and the palm, thumb, and fingers of the user's hand are placed in the plurality recesses on the domed hand support section, the domed face supports the user's hand in the naturally curved open position while the user exerts force against the domed hand support section face and that is at least partially directed toward the supporting surface. Also, when the domed hand support is lifted using different members of the plurality of interchangeable weighted members, a resistance resulting from lifting the domed hand support is changed.

Additionally, a method of performing upper body exercise is disclosed for using an apparatus according to the present disclosure. A hand is engaged with a domed hand support section, the domed hand support section having a plurality of recesses configured to receive a palm, thumb, and fingers of a user's hand while the user's hand is held in a naturally curved open-position. A surface engagement section secured to an underside of the domed hand support section is deployed on a generally planar support surface. The surface engagement section is configured to slideably move across the generally planar support surface in two dimensions; also, while resting at least a portion of a user's body weight on the domed support section via the user's hand, moving the domed hand support section in both of the two dimensions across the generally planar support surface.

Also, a method of performing upper body exercise using an apparatus is disclosed for using an apparatus according to the present disclosure. A hand is engaged with a domed hand support section of the apparatus. The domed hand support section has a plurality of recesses configured to receive a palm, thumb, and fingers of a user's hand. While the user's hand is held in a naturally curved open-position and a strap configured to extend across a back of the user's hand while the user's hand is received in the plurality of recesses. At least some portion of the user's arm is lifted. A mass of the apparatus provides resistance to the lifting while the user's hand is held in the naturally curved open-position.

Other apparatuses, systems, and methods are further described in detail below.

DETAILED DESCRIPTION

Apparatuses, systems, and methods are disclosed for enhancing upper body exercise. In various embodiments described in detail below, a user's hand is received into recesses on a domed hand support section that is configured to receive the user's palm, thumb, and fingers in a naturally open-handed position. A surface engagement section is configured to secure the domed hand support section in a stationary position or to enable the domed hand support to slide or roll to perform various surface-based exercises. Additionally, taking advantage of optional wrist braces or straps to secure the user's hand within the recesses, the user may perform various lifting exercises as described in detail below.

Figure 1:
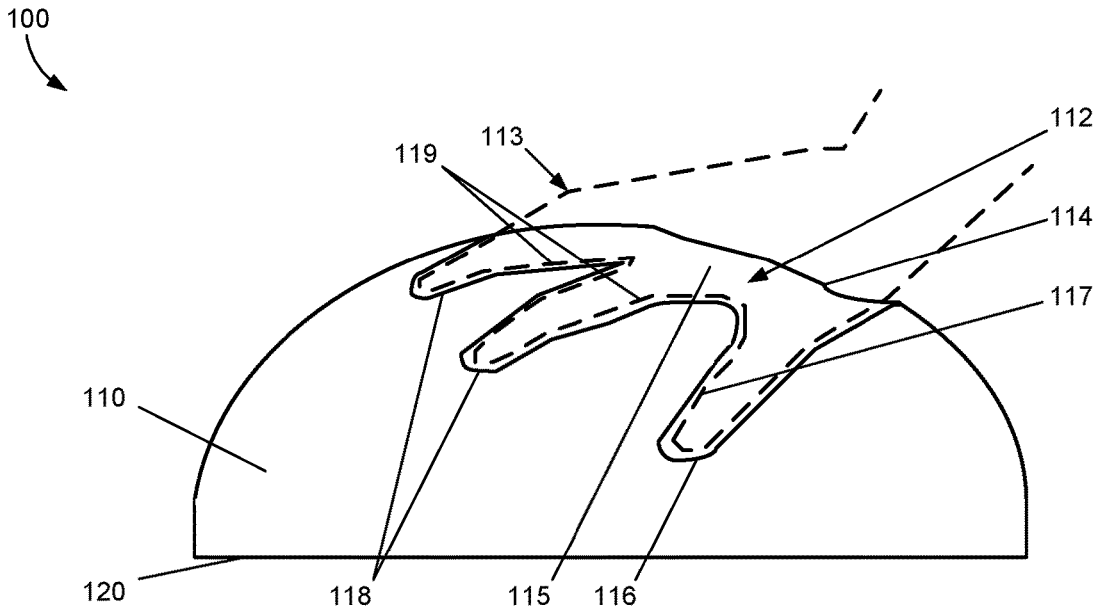
FIGS. 1 and 2 are side elevation views of an embodiment of a hand support apparatus according to the present disclosure.
Figure 2:
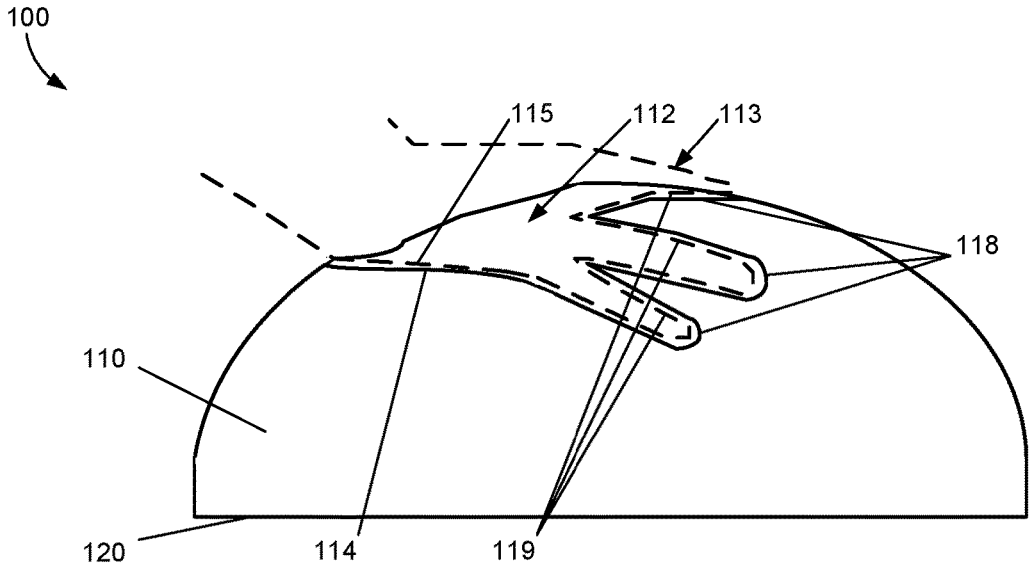

FIGS. 1 and 2 are side elevation views of an embodiment of an apparatus 100 according to the present disclosure. FIGS. 1 and 2 show opposite sides of the apparatus 100 which, in a particular embodiment, is a hand support device configured to facilitate weight-bearing exercises. An outline of a user's hand 113, represented by a dashed line, is shown engaging the apparatus 100 to illustrate how the apparatus 100 may be used. The apparatus 100 generally includes a domed hand support section 110 and a surface engagement section 120. The surface engagement section 120 is configured to rest on a supporting surface, such as a floor (not shown in FIG. 1 or 2), while the user's hand 113 engages the domed hand support section 110, as further described below.

The apparatus 100 includes a domed hand support section 110 that may be either permanently or releasably coupled with a surface engagement section 120, as further described with reference to FIGS. 14-19. In the embodiment shown in FIGS. 1 and 2, the domed hand support section 110 may be a regular, hemispherically-shaped structure. For reasons explained below, the domed hand support section 110 should be tallest at its middle and slope downward toward the edges, but the domed hand support section 110 need not be a round or regular dome. The term "dome" is used to describe a structure that is elevated toward its middle.

The domed hand support section 110 includes a recess 112 configured to receive an underside of a user's hand 113. Specifically, the recess 112 includes a plurality of recesses 114, 116, and 118. A palm recess 114 is configured to receive a palm 115 of the user's hand 113; a thumb recess 116 is configured to an underside of the user's thumb 117; and one or more finger recesses 118 are configured to receive undersides of the user's fingers 119. The embodiment of the apparatus 100 shown in FIGS. 1 and 2 includes separate finger recesses 118 for each of the four fingers (not counting the thumb as a finger) 119 of the user's hand 119; however, other embodiments may provide combined recesses for two or more of the fingers 119. For example, a single recess may be provided for both the third and fourth fingers of the hand 113 as counted away from the thumb (commonly termed the "ring finger" and "pinky finger," respectively); alternatively or additionally, a single recess may be provided for both the first and second fingers of the hand 113 (commonly referred to as the "index finger" and "middle finger," respectively). The disclosure is not limited to an embodiment in which separate recesses are provided for each of the fingers 119 of a user's hand 113.

Referring again to FIGS. 1 and 2, the palm recess 114, the thumb recess 116, and the finger recesses 118 are positioned across the curved surface of the domed hand support section 110 so as to receive a user's hand 113 in a relaxed, open position; in the relaxed open position, there is some natural inward curvature of the fingers 119 (i.e., the fingers 119 curve inward in the direction faced by the palm 115). In a particular embodiment, the domed hand support section 110 is formed and/or covered with a slip-resistant material to retain the user's palm 115, thumb 117, and fingers 119 within the palm recess 114, thumb recess 116, and finger recesses 118, respectively.

As described in the background portion of this document, one of the problems faced by a person seeking to perform conventional push-ups with his or her hands flat on the ground is the strain placed on the base of the palm and on the fingers and thumbs because the fingers and thumbs are pressed flat (i.e., beyond the fingers' naturally curved position) by the force of the body weight pressing down on the hands. However, performing push-ups or similar exercises using embodiments according to the present disclosure, a user may press his or her weight on his or her hands without having to stress the muscles of the palm 115, thumb 117, and fingers 119. Instead, embodiments according to the present disclosure, the user can perform push-ups with the fingers and thumbs remaining in curved positions, reducing strain. The curvature of the domed hand support section 110 fully engages the user's palm 115, thumb 117, and fingers 119 and facilitates even distribution of his or her weight across the palm 115, thumb 117, and fingers 119 instead of resting the weight on the edges of the palm or ends of the fingers, as may occur performing conventional, flat-handed push-ups.

Figure 3:
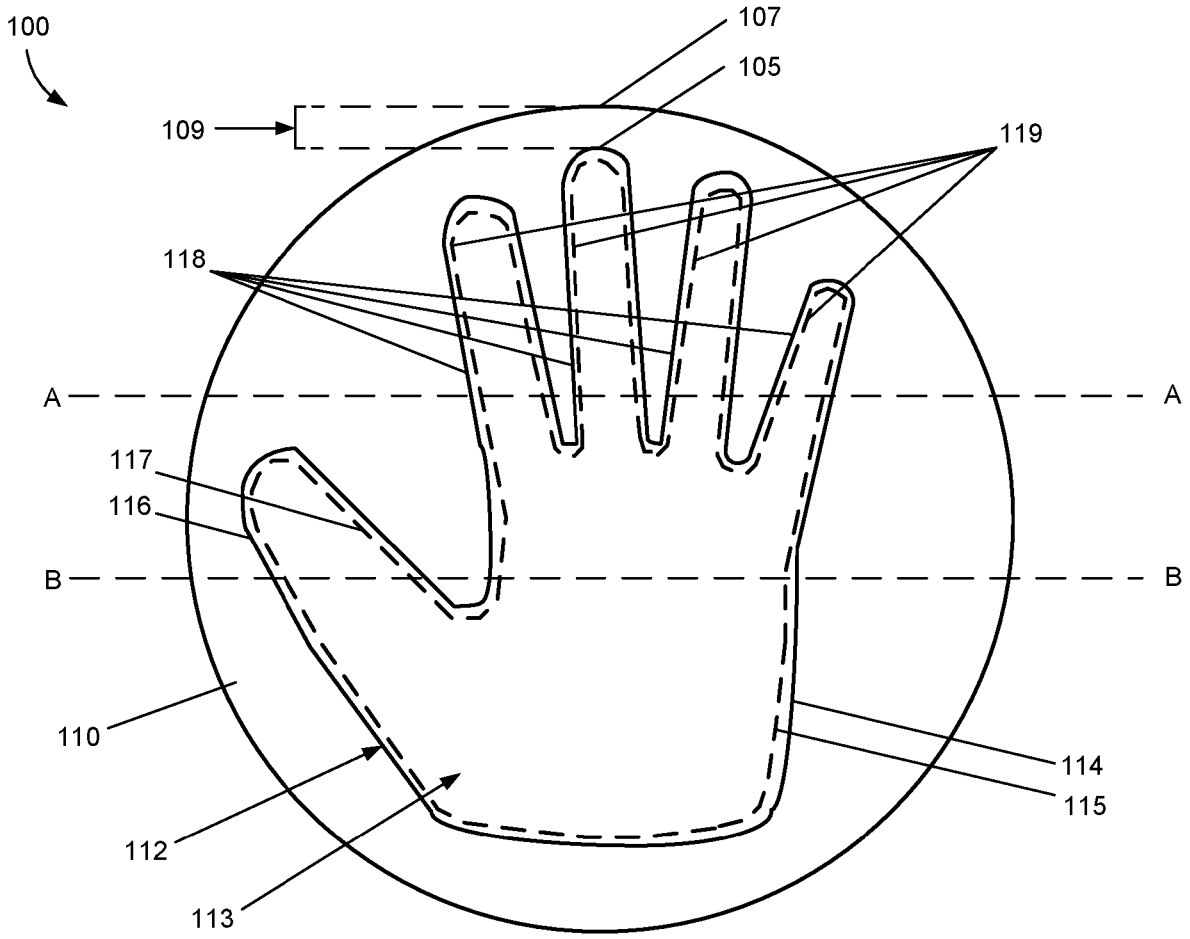
FIG. 3 is a top view of an embodiment of a hand support apparatus according to the present disclosure.

FIG. 3 is a top view of an embodiment of a hand support apparatus 100 according to the present disclosure. As in FIGS. 1 and 2, FIG. 3 shows the domed hand support section 110 formed with the palm recess 114, thumb recess 116, and finger recesses 118 configured to receive and contain the user's palm 115 and undersides of the user's thumb 117 and fingers 119. As further described with reference to FIGS. 4 and 5, the palm recess 114, thumb recess 116, and finger recesses 118 are curved to conform to the underside of the user's hand 113. Further, in order to protect the user's hand 113, the recesses 114, 116, and 118 of the domed hand support section 110 are configured to contain the edges of the palm 115, thumb 117, and fingers 119, respectively, away from edges of the domed hand support section 110. For example, a distal end 105 of the finger recess 118 for the middle finger is removed by a distance 109 from the adjacent edge 107 of the apparatus 100. Thus, if the apparatus 100 is laterally moved into an obstacle (not shown in FIG. 3), while the apparatus 100 may impact that obstacle, the user's hand 113 is protected from impacting the same obstacle.

Figure 4:
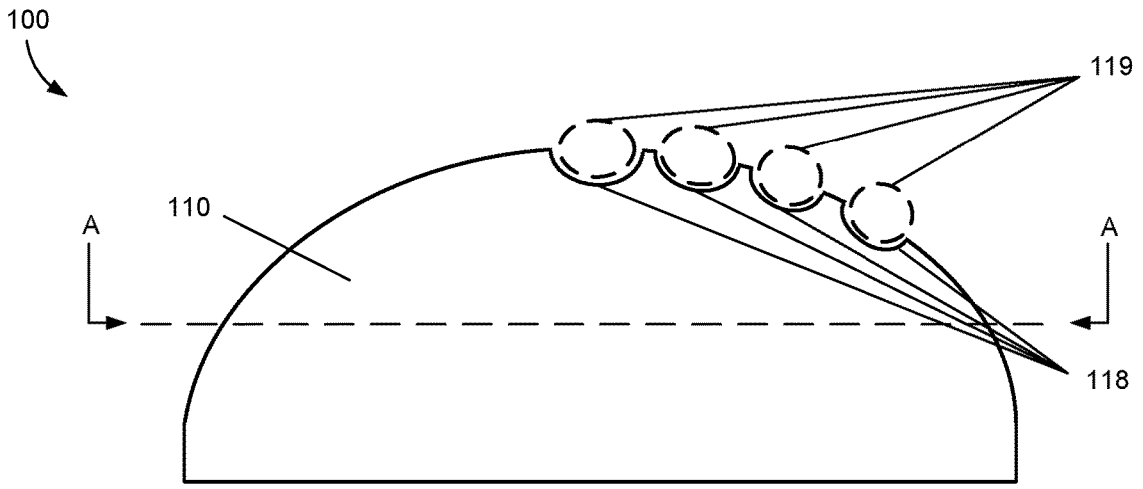
FIG. 4 is a cross-sectional view of the embodiment of the hand support apparatus as shown in FIG. 3 taken along axis A-A.
Figure 5:
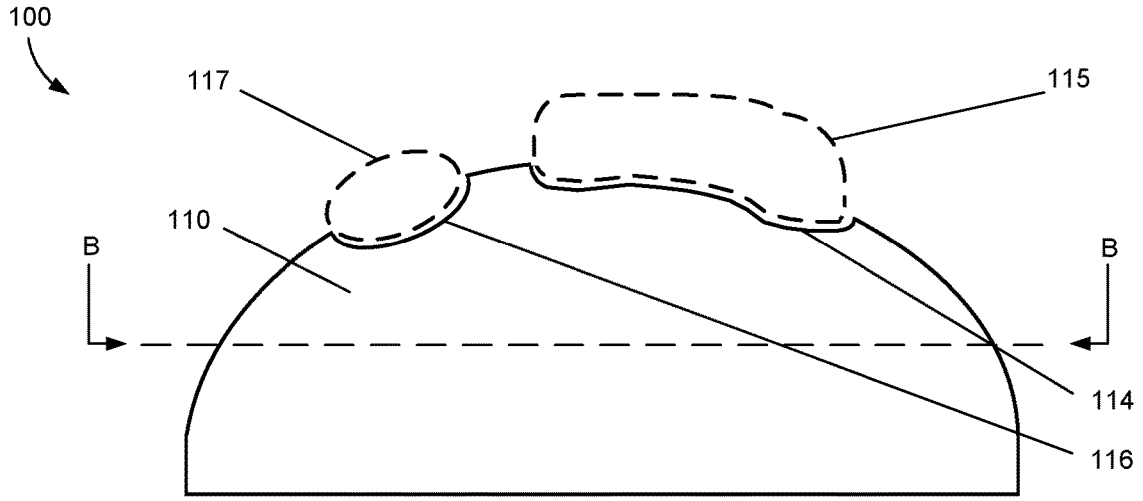
FIG. 5 is a cross-sectional view of the embodiment of the hand support apparatus as shown in FIG. 3 taken along axis B-B.

FIGS. 4 and 5 are cross-sectional views of the embodiment of the apparatus 100 as shown in FIG. 3 taken along axis A-A and axis of B-B of FIG. 3, respectively. FIG. 4 shows a cross-sectional view of the apparatus 100 across the finger recesses 118 formed in the domed hand support section 110. As shown in FIG. 4, the finger recesses 118 are curved to correspond to the curvature of the underside of the fingers 119. The recesses 118 thus cradle and engage the fingers 119, allowing the user's fingers 119 to securely engage the domed hand support section 110. Similarly, FIG. 5 shows a cross-sectional view of the apparatus 100 across the palm recess 114 and the thumb recess 116 formed in the domed hand support section 110. As shown in FIG. 5, the palm recess 114 and the thumb recess 116, like the finger recesses 118, are curved to correspond to the curvature of the palm 115 and the underside of the thumb 117. Thus, the recesses 114 and 116 cradle and engage the palm 115 and thumb 117 to securely engage the domed hand support section 110.

Figure 6:
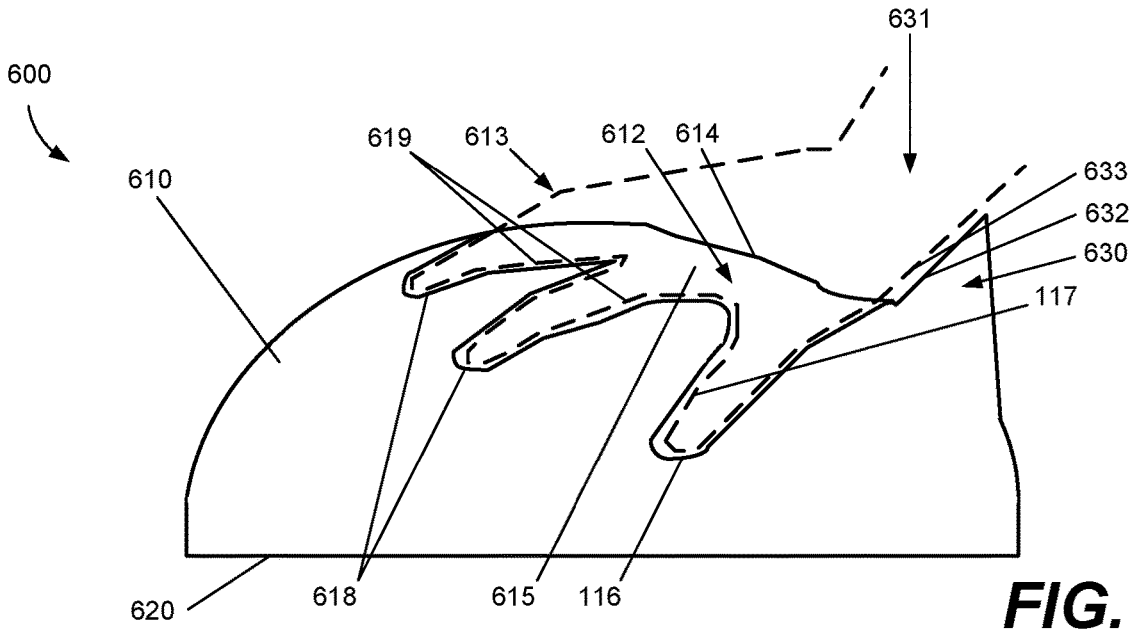
FIG. 6 is a side elevation view of an embodiment of a hand support apparatus featuring a wrist brace according to the present disclosure.

FIG. 6 is a side elevation view of an embodiment of a hand support apparatus 600 featuring a wrist brace 630 according to the present disclosure. Similar to the embodiment of the apparatus 100 as described with reference to FIGS. 1-5, the apparatus 600 includes a domed hand support section 610 and a surface engagement section 620. An outline of a user's hand 613, represented by a dashed line, is shown engaging the apparatus 600. The surface engagement section 620 is configured to rest on a supporting surface, such as a floor (not shown in FIG. 6), while the user's hand 613 engages the domed hand support section 610, as further described below. The domed hand support section 610 may be either permanently or releasably coupled with a surface engagement section 620, as further described with reference to FIGS. 14-19. The domed hand support section 610 may be a regular, hemispherically-shaped structure or a different shape that is tallest at its middle, as previously described. The domed hand support section 610 includes a recess 612 configured to receive an underside of the user's hand 613. Specifically, the recess 612 includes a plurality of recesses 614, 616, and 618. A palm recess 614 is configured to receive a palm 615 of the user's hand 613; a thumb recess 616 is configured to an underside of the user's thumb 617; and one or more finger recesses 618 are configured to receive undersides of the user's fingers 619. As described with reference to FIGS. 1-5, embodiments of the apparatus 600 according to the disclosure are not limited to embodiments having individual recesses for each of the fingers 619, but may, instead, provide recesses that may accommodate more than one finger.

In addition to incorporating the features of the apparatus 100 of FIGS. 1-5, the apparatus 600 includes a wrist brace 630. As shown in FIG. 6, the wrist brace is a protrusion extending upward from the domed hand support section 610 adjacent to a point where the palm recess 614 receives the base of the palm 615 and, thus, the point where the end of the user's wrist 631 extends over the domed hand support section 610. The wrist brace 630 extends upward from the domed support surface 610 and provides a wrist support surface 632 configured to engage and support an underside 633 of the user's wrist 631. The wrist support surface 632 thus provides underlying support for the user's wrist 631 when the user presses his or her weight down on the apparatus 610, thus potentially alleviating at least a portion of the wrist strain that may result from conventional, hand-on-the-floor push-ups.

Figure 7:
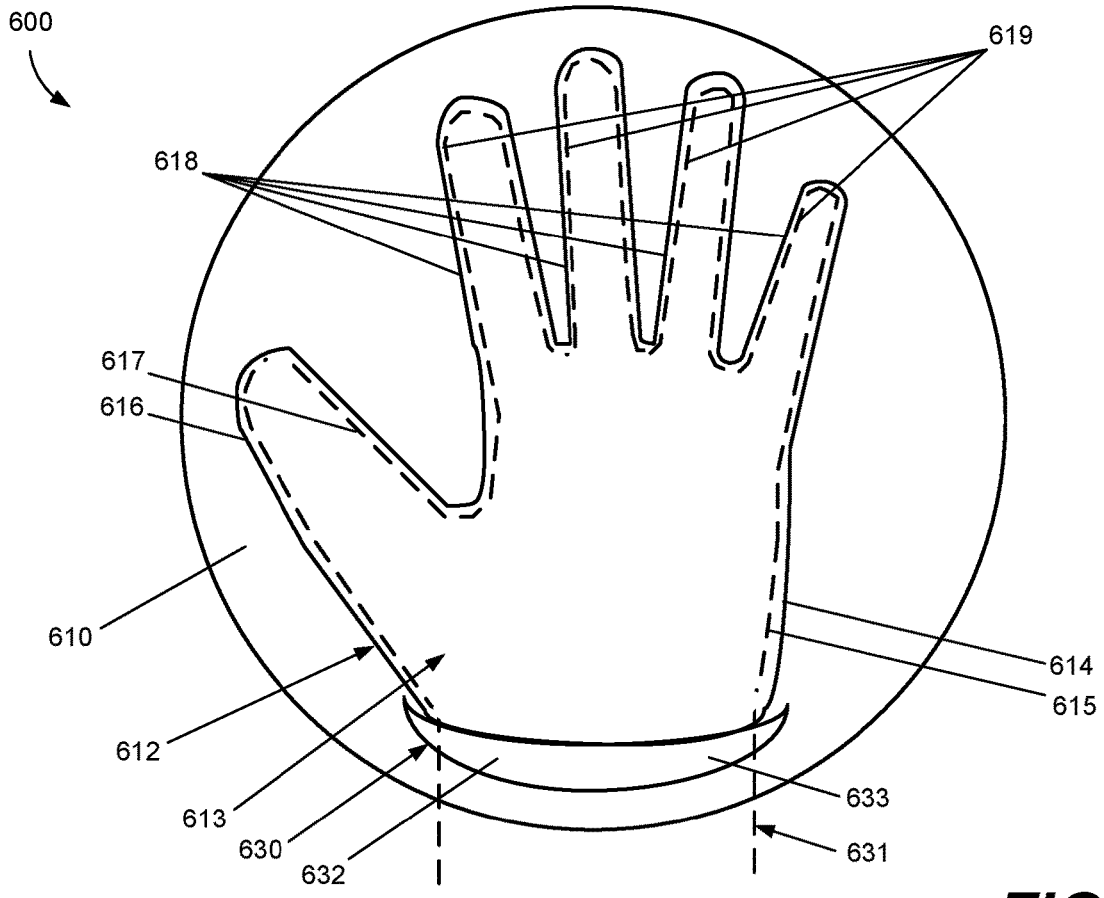
FIG. 7 is a top view of an embodiment of a hand support apparatus featuring a wrist brace according to the present disclosure.

FIG. 7 is a top view of an embodiment of the apparatus 610 featuring the wrist brace 630 according to the present disclosure. As described with reference to FIG. 6, the wrist brace 630 extends upward from the domed hand support section 610 across a region where the user's wrist 631 extends over the domed support surface 610 when the user's hand 613 is positioned in the hand recess 612. The wrist support surface 632 extends across an underside 633 of the wrist 631 to support the user's wrist 631 to alleviate wrist strain.

Figure 8:
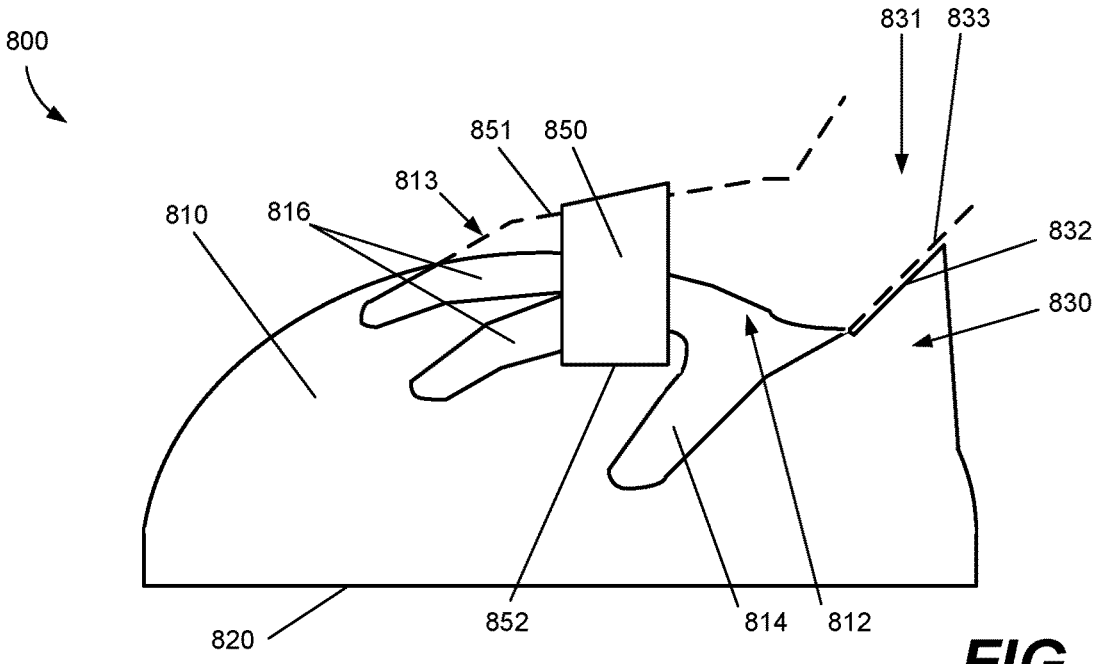
FIG. 8 is a side elevation view of an embodiment of a hand support apparatus featuring a wrist brace and a support strap according to the present disclosure.

FIG. 8 is a side elevation view of an embodiment of an apparatus 800 featuring a wrist brace 830 and a support strap 850 according to the present disclosure. Similar to the embodiment of the apparatus 100 as described with reference to FIGS. 1-5 and the embodiment of the apparatus 600 as described with reference to FIGS. 6 and 7, the apparatus 800 includes a domed hand support section 810 and a surface engagement section 820. An outline of a user's hand 813, represented by a dashed line, is shown engaging the apparatus 800. The surface engagement section 820 is configured to rest on a supporting surface, such as a floor (not shown in FIG. 8), while the user's hand 813 engages the domed hand support section 810, as further described below. The domed hand support section 810 may be either permanently or releasably coupled with a surface engagement section 820, as further described with reference to FIGS. 14-19. The domed hand support section 810 may be a regular, hemispherically-shaped structure or a different shape that is tallest at its middle, as previously described. The domed hand support section 810 includes a recess 812 configured to receive an underside of the user's hand 813. Specifically, the recess 812 includes a plurality of recesses 814, 816, and 818. A palm recess 814 is configured to receive a palm 815 of the user's hand 813; a thumb recess 816 is configured to an underside of the user's thumb 817; and one or more finger recesses 818 are configured to receive undersides of the user's fingers 819. As described with reference to FIGS. 1-7, embodiments of the apparatus 800 according to the disclosure are not limited to embodiments having individual recesses for each of the fingers 819, but may, instead, provide recesses that may accommodate more than one finger.

Figure 9:
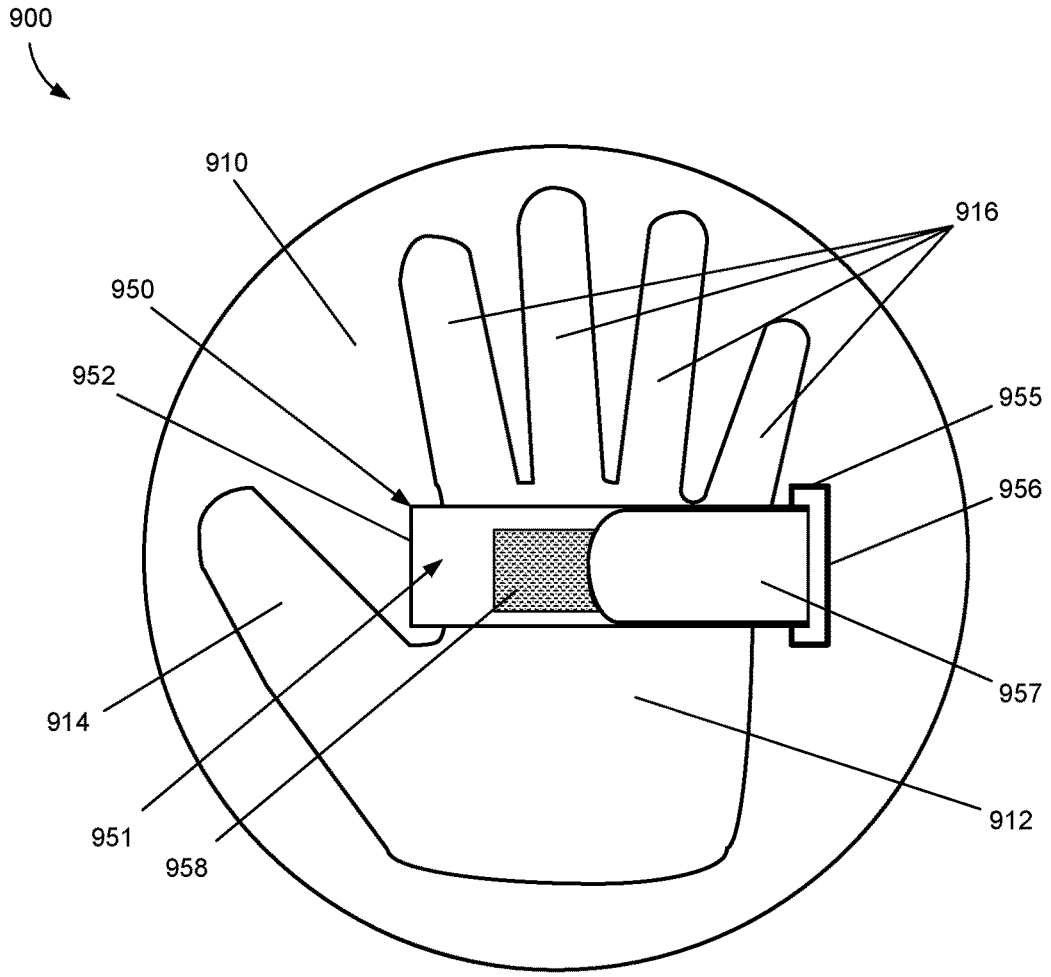
FIG. 9 is a top view of an embodiment of a hand support apparatus featuring a support strap according to the present disclosure.

In addition to incorporating the features of the apparatus 100 of FIGS. 1-5 and the apparatus 600 of FIGS. 6-7 (i.e., the wrist brace 830 having a wrist support surface 832 for engaging an underside 833 of a user's wrist 831), the apparatus 800 includes a support strap 850. The support strap 850 is configured to engage a back 851 of the user's hand (i.e., the side opposite the palm). As shown in FIG. 8, the support strap 850 may be fixably anchored to the domed hand support section 810 at each of two ends. One end is anchored to the domed hand support section between the thumb recess 816 and a finger recess 818 for the first finger or index finger. As shown in FIG. 9, an opposite end of the support strap 850 may be anchored adjacent the finger recess 818 that accommodates the fourth or pinky finger.

The support strap 850 may be an elastic or flexible material to enable the user to fit his or her hand 813 within the hand recess 812 and under the support strap 850. The support strap 850 secures the user's hand 813 within the hand recess 812 to help keep the user's hand 813 within the hand recess 812 when the user exercises using the apparatus 800 as previously described, i.e., moving the apparatus 810 such that the surface engagement section 820 moves over a supporting surface (not shown in FIG. 8). Alternatively, the support strap 850 may secure the user's hand 813 atop the domed hand support section 810 as the user lifts the user's hand 813, enabling the user to employ the apparatus 800 as a hand weight to perform curls, lifts, or raises.

FIG. 9 is a top view of an embodiment of an apparatus 900 featuring a support strap 950 according to the present disclosure. Similar to the embodiment of the apparatus 100 as described with reference to FIGS. 1-5 and the embodiment of the apparatus 600 as described with reference to FIGS. 6 and 7, and the apparatus 800 of FIG. 8. The apparatus 900 includes a domed hand support section 910. The domed hand support section 910 may be a regular, hemispherically-shaped structure or a different shape that is tallest at its middle, as previously described. The domed hand support section 910 includes a recess 912 configured to receive an underside of the user's hand (not shown in FIG. 9). Specifically, the recess 912 includes a plurality of recesses 914, 916, and 918. A palm recess 914 is configured to receive a palm of the user's hand; a thumb recess 916 is configured to an underside of the user's thumb; and one or more finger recesses 918 are configured to receive undersides of the user's fingers. As described with reference to FIGS. 1-8, embodiments of the apparatus 800 according to the disclosure are not limited to embodiments having individual recesses for each of the fingers, but may, instead, provide recesses that may accommodate more than one finger.

Comparing the apparatus 100 of FIGS. 1-3, the apparatus 600 of FIGS. 6 and 7, the apparatus 800 of FIG. 8, and the apparatus 900 of FIG. 9, it should be appreciated that embodiments of the apparatus according to the present disclosure may include various combinations of features. For example, the apparatus 100 may include neither a wrist brace (as in the apparatus 600 of FIGS. 6 and 7 or the apparatus 800 of FIG. 8) nor a support strap (as in the apparatus 800 of FIG. 8 or the apparatus 900 of FIG. 9); the apparatus 600 may include a wrist brace 630, but no support strap (as in the apparatus 800 of FIG. 8 or the apparatus 900 of FIG. 9); the apparatus 800 may include both a wrist brace 830 and a support strap 850 (as in the apparatus 800 of FIG. 8); or a wrist support 950 but not a wrist brace (as in the apparatus 600 of FIGS. 6 and 7 or the apparatus 800 of FIG. 8).

FIG. 9 also illustrates an embodiment 900 in which the support strap 950 may include an adjustable body 951 to enable the user to adjust the length of the support strap 950 for the sake of comfort and/or to adjust how tightly the user's hand is secured within the hand recess 912. The adjustable body 951 may be fixably anchored to the domed hand support section 910 at a fixed end 952 and slidably anchored to the domed hand support section 910 via a buckle 955 fixably secured to the domed hand support section 910 at an adjustable end 956. A length of the adjustable body 951 may then be set by securing a free end 957 of the adjustable body 951 with a closure 958 fixably attached or integrated with the adjustable body 951. The closure 958 may be a hook and loop fastener, a buckle, a set of mechanical snaps, or another closure mechanism. In embodiments in which one of the ends of the adjustable body 951 is fixably attached and the other end is slidably attached, the fixed end and adjustable end may be disposed at either end of the support strap 950 (i.e., in contrast to the embodiment of the apparatus 900 shown in FIG. 9, the slidably attached end may be secured to the domed hand support section at a side of the user's hand adjacent the index finger with the fixed end at an opposite side of the hand). Alternatively, the adjustable body 951 may include two sections that are adjustably joined to each other via closures such as previously described.

FIGS. 10-13 are bottom views of alternate forms of surface engagement sections 1022, 1122, 1222, and 1322 of the apparatus according to embodiments of the present disclosure. As described with reference to FIGS. 10-13, embodiments of surface engagement sections 1022, 1122, 1222, and 1322 of the apparatus may include surface engagement sections with solid bottoms, surface engagement sections with an opening in their surfaces, and surface engagement sections that are designed either to slide or resist sliding across a support surface. As further described below, embodiments of the apparatus also may include surface engagement sections that provide for a spherical bearing to extend therethrough to rollingly support the apparatuses above a support surface; embodiments of the apparatus may also include removably attached and/or interchangeable surface engagement sections, all as further described below.

Figure 10:
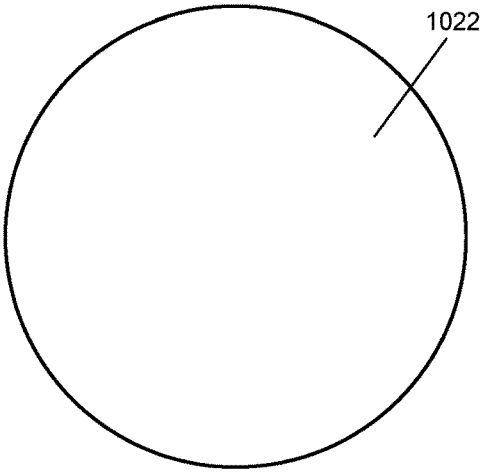
FIGS. 10-13 are bottom views of alternate forms of a surface engagement section of the apparatus according to embodiments of the present disclosure.

Specifically, FIG. 10 shows a solid surface engagement section 1022. In one embodiment, the solid surface engagement section 1022 is comprised of a material configured to slidably move across a support surface (not shown in FIG. 10) to permit a user to perform exercises that involve sliding the apparatus over the support surface, as further described below with reference to FIGS. 20-23, while retaining the advantages of employing a domed hand support section in supporting the hand and fingers as previously described. The surface engagement section 1022 may be comprised of a smooth metal or plastic that slides relatively easily over a hard floor, carpet, and/or a sliding board.

Figure 11:
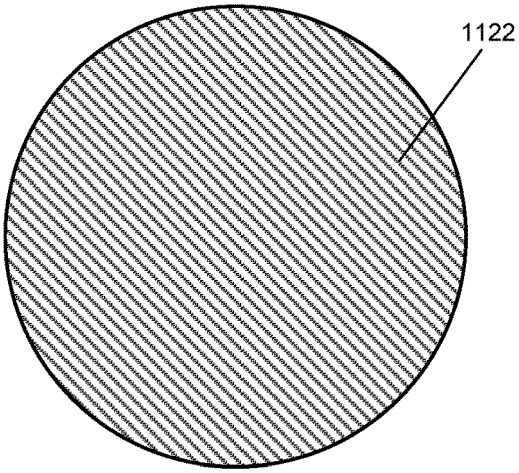

FIG. 11 shows another embodiment of a solid surface engagement section 1122 comprised of a material configured to resist sliding across a support surface (not shown in FIG. 11). The solid surface engagement section 1122 may include a textured and/or rubberized surface engagement section that prevents the solid surface engagement section 1122 from sliding across a hard surface and/or a carpet. Such an embodiment permits a user to perform exercises that do not involve sliding the apparatus over the support surface while retaining the advantages of employing a domed hand support section in supporting the hand and fingers as previously described.

Figure 12:
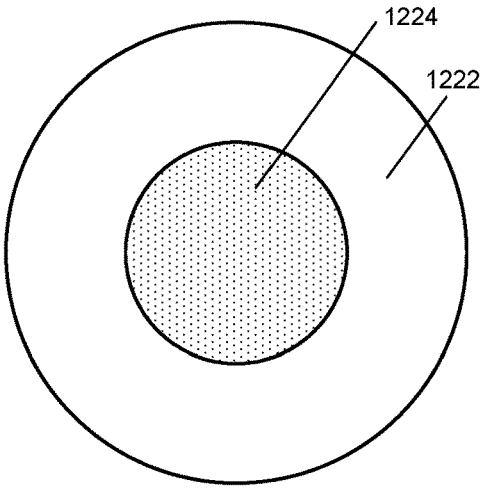

FIG. 12 shows an open surface engagement section 1222 in which the surface engagement section accommodates an opening 1224. In one embodiment, the open surface engagement section 1222 is comprised of a material configured to slidably move across a support surface (not shown in FIG. 12) to permit a user to perform exercises that involve sliding the apparatus over the support surface, as further described below with reference to FIGS. 20-23, while retaining the advantages of employing a domed hand support section in supporting the hand and fingers as previously described. The surface engagement section 1222 may be comprised of a smooth metal or plastic that slides relatively easily over a hard floor, carpet, and/or a sliding board. The opening 1224 may be configured to permit a spherical bearing to extend therethrough as further described below with regard to FIGS. 16-18.

Figure 13:
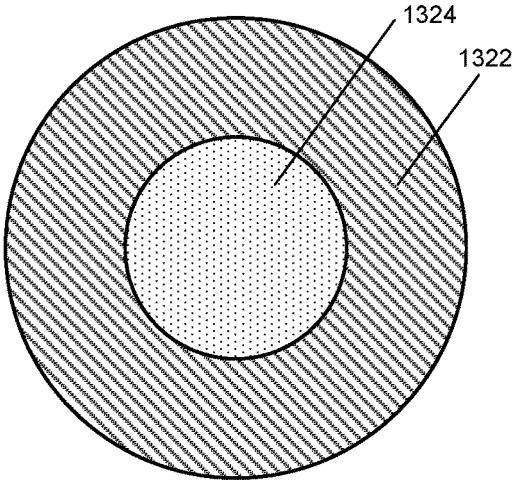

FIG. 13 shows an open surface engagement section 1322 in which the surface engagement section accommodates an opening 1324. In one embodiment, the open surface engagement section 1322 is comprised of a material configured to resist movement across a support surface (not shown in FIG. 12) to permit a user to perform exercises that may not involve sliding the apparatus over a support surface while retaining the advantages of employing a domed hand support section in supporting the hand and fingers as previously described. The open surface engagement section 1322 may include a textured and/or rubberized surface engagement section that prevents the open surface engagement section 1322 from sliding across a hard surface and/or a carpet. The opening 1324 may be configured to permit a spherical bearing to extend therethrough as further described below with regard to FIGS. 16-18. By including an open surface engagement section 1324 configured to resist sliding and a spherical bearing as further described below, a user may be able to selectably allow the apparatus to roll over a surface by angling the apparatus so that the apparatus rests mainly or entirely on the spherical bearing; alternately, the user may limit the sliding of the apparatus by angling the apparatus so that the apparatus rests partly on the spherical bearing and partly on the slide-resistant open surface engagement section 1324.

Figure 14:
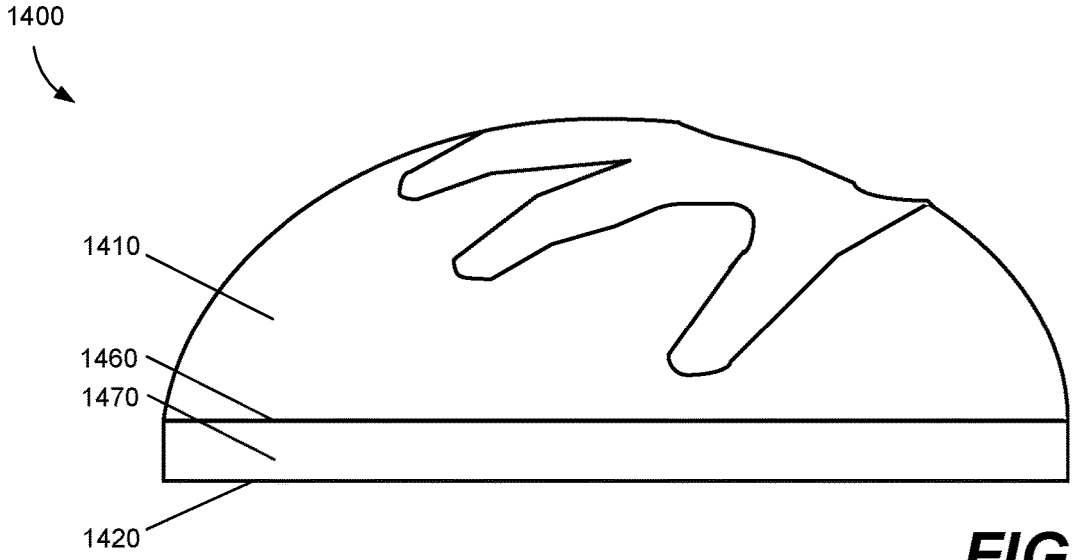
FIG. 14 is a side elevation view of an embodiment of a hand support apparatus in which a domed support member and a surface engagement section are removably attached according to an embodiment of the present disclosure.

FIG. 14 is a side elevation view of an embodiment of an apparatus 1400 in which a domed support member 1410 and a surface engagement section 1420 are removably attached according to an embodiment of the present disclosure. Removable attachment of the surface engagement section 1420 facilitates assembly of the apparatus 1400. Additionally, removable attachment of the surface engagement section 1420 allows for attachment of different surface engagement sections or interchangeable surface engagement sections, as described with reference to FIGS. 10-13 and as further described below. In one embodiment, the surface engagement section 1420 includes a surface engagement section 1470 that joins to the domed hand support section 1410 at a joint or seam 1460. The surface engagement section 1470 may be coupled to the domed hand support section 1410, for one example, as described below with reference to FIG. 15.

Figure 15:
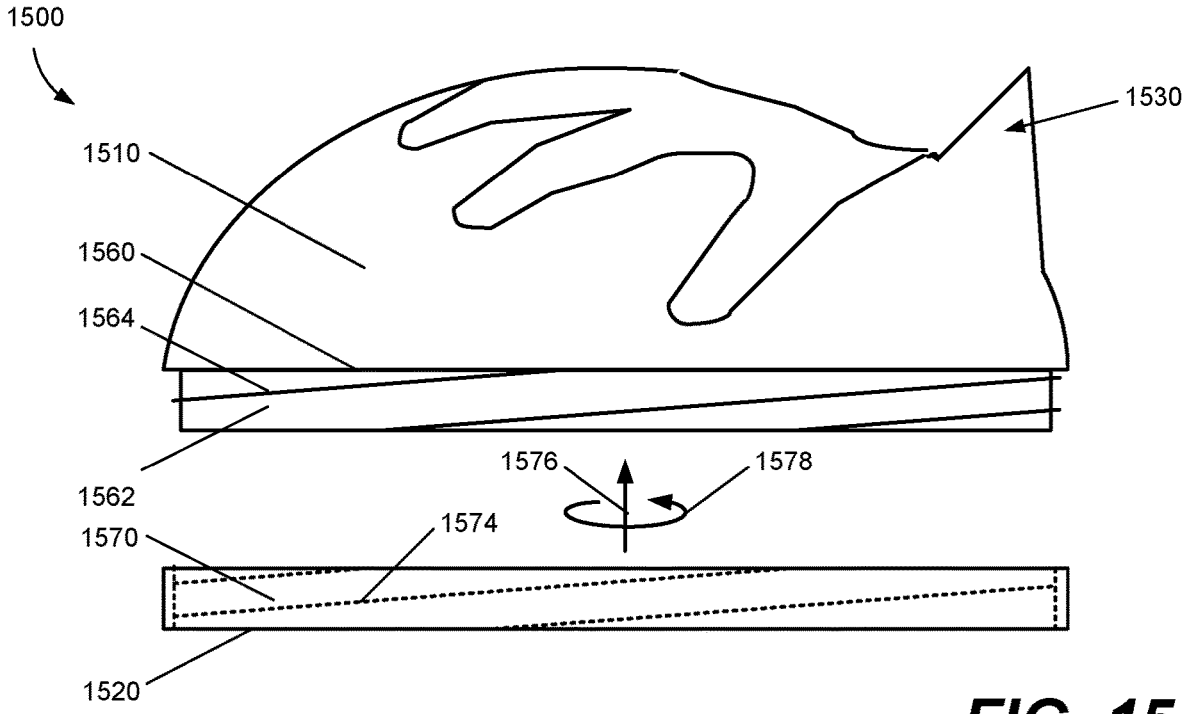
FIG. 15 is an exploded view of an embodiment of a hand support apparatus in which a domed support member and a surface engagement section are removably attached according to an embodiment of the present disclosure.

FIG. 15 is an exploded view of an embodiment of a hand support apparatus 1500 in which a domed hand support section 1510 and a surface engagement section 1520 are removably attached according to an embodiment of the present disclosure. As shown in FIG. 15, the domed hand support section 1510 includes a sleeve 1562 configured to be received within the surface engagement section 1570. The sleeve 1562 includes outwardly-facing threads 1564 configured to engage inwardly-acing threads 1574 within the surface engagement section (although it should be understood that the surface engagement section 1570 may support a sleeve that provides outwardly-facing threads that could be received by inwardly-facing threads included within the domed hand support section 1510). The domed hand support section 1510 and the surface engagement section 1570 may be secured to each other by moving the surface engagement section in a direction 1576 toward the domed hand support section 1510 and then twisted in a direction 1578 to engage the inwardly-facing threads 1574 of the surface engagement section with the outwardly-facing threads 1564 of the sleeve 1562 of the domed hand support section 1510, causing the domed hand support section 1510 and the surface engagement section 1570 to be joined together at a seam 1560. The process may be reversed and/or repeated as desired to secure different surface engagement sections (not shown in FIG. 15) to the domed hand support section 1510, to install or replace spherical bearings (also not shown in FIG. 15) within the domed hand support section 1510 or to remove the same, as further described below. The domed hand support section 1510 includes a wrist brace 1530 as previously described with reference to FIGS. 6 and 7.

Figure 16:
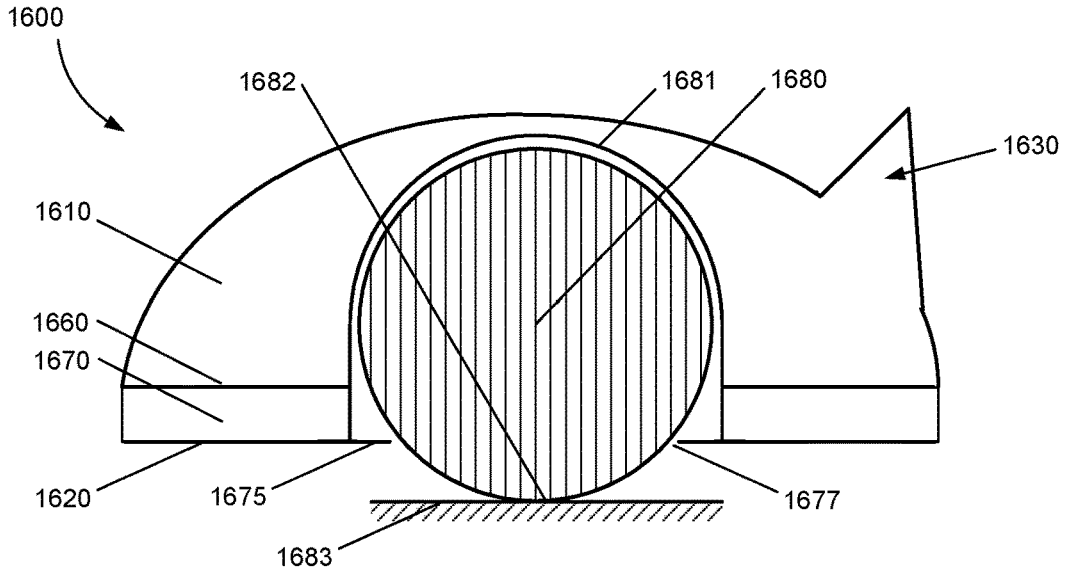
FIG. 16 is a cross-sectional view of an embodiment of a hand support apparatus in which a domed support member includes a recess configured to partially receive a spherical bearing and a surface engagement section configured to retain the spherical bearing according to an embodiment of the present disclosure.

FIG. 16 is a cross-sectional view of an embodiment of a hand support apparatus 1600 in which a domed support member 1610 includes a recess 1681 configured to partially receive a spherical bearing 1680 and a surface engagement section 1670 configured to retain the spherical bearing 1680 so as to enable the spherical bearing 1680 to partially extend beyond a surface of a surface engagement section 1620. An object of the partially-extended spherical bearing is to enable the spherical bearing 1680 to roll across a support surface 1683 to facilitate exercises in which a user rolls the apparatus 1600 over the support surface. The domed hand support section 1610 includes a wrist brace 1630 as previously described with reference to FIGS. 6 and 7.

The recess 1681 is configured to rollably receive the spherical bearing 1680 to allow easy rolling of the spherical bearing within the domed support member 1610 so that, as lateral forces are applied to the apparatus 1600, the apparatus may move in any direction relative to a plane defined by the support surface 1683. The surface engagement section 1670 includes an open surface engagement section 1620 that includes an opening 1677 through which the spherical bearing 1680 may extend to present a rolling surface 1682 against the support surface 1683. According to a particular embodiment, the surface engagement section 1670 provides a flange 1675 that defines the opening 1677 as having a width that is smaller than a diameter of the spherical bearing 1680 such that the spherical bearing 1680 may partially extend through the opening 1677 but not fall through the opening 1677. Also in a particular embodiment, the flange 1675 may be sized so that when the surface engagement section 1670 is secured to the domed hand support section 1610 at a joint 1660, the spherical bearing 1680 is confined within the recess 1681 such that the spherical bearing 1680 is permitted to roll within the recess 1681 but with limited vertical movement transverse to the surface engagement section 1620 so that the spherical element 1680 does not "wiggle" transverse to the surface engagement section 1620.

Figure 17:
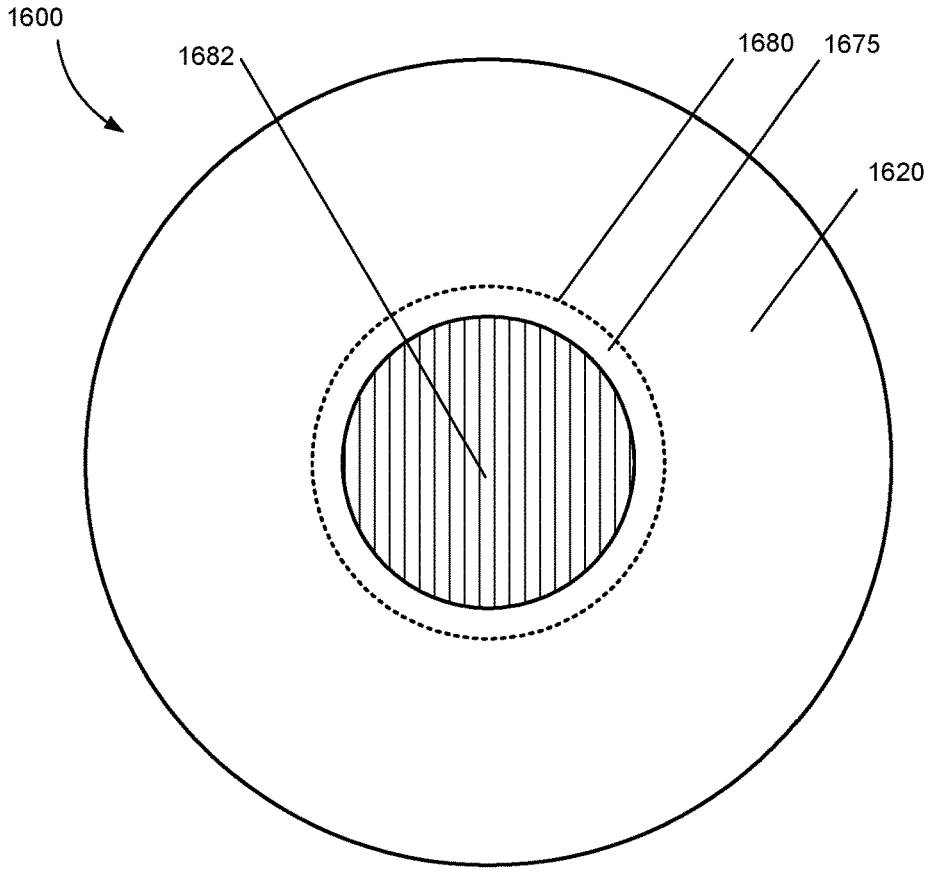
FIG. 17 is a bottom view of a surface engagement section including a flange configured to retain the spherical bearing within the apparatus according to an embodiment of the present disclosure.

FIG. 17 is a bottom view of the surface engagement section 1620 including the flange 1675 configured to retain the spherical bearing 1680 within the apparatus according to an embodiment of the present disclosure. As described with reference to FIG. 16, the flange 1675 contains the spherical bearing 1680 (whose diameter is partially covered by the surface engagement section 1620 and thus is represented by a dashed line) but allows the rolling surface 1682 of the spherical bearing to extend therethrough, thus enabling the rolling surface 1682 to engage a support surface (not shown in FIG. 17).

Figure 18:
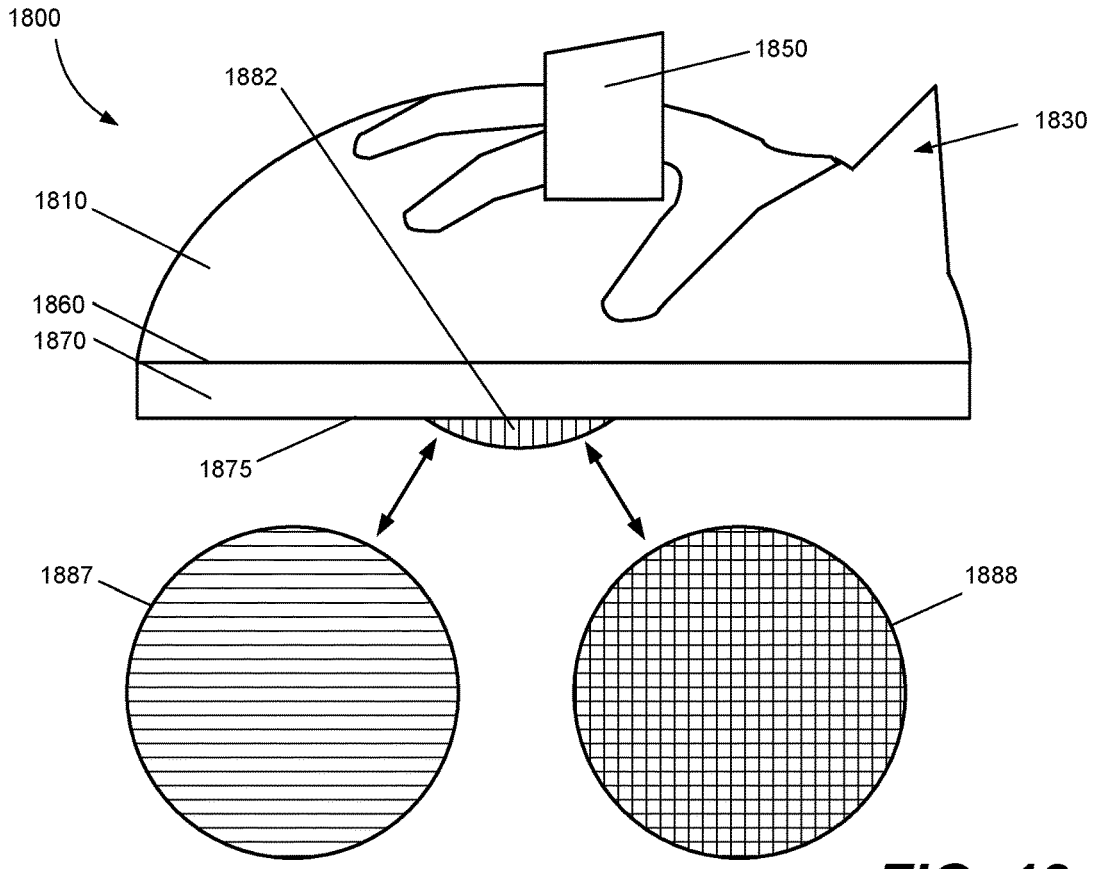
FIG. 18 is a side elevation view of an embodiment of a system including a hand support apparatus and interchangeable spherical bearings of different weights according to an embodiment of the present disclosure.

FIG. 18 is a side elevation view of an embodiment of a system 1800 including an apparatus having interchangeable spherical bearings 1882, 1887, and 1888 according to an embodiment of the present disclosure. The interchangeable spherical bearings 1882, 1887, and 1888 may have different weights. An object of the interchangeable spherical bearings 1882, 1887, and 1888 is to enable a user to engage the system 1800 for rolling exercises as described in this disclosure as well as to use the system to provide adjustable hand weights. To change the weight, a user could use processes as described with reference to FIG. 15 to remove a surface engagement section 1870 from the domed hand support section 1810 so as to remove and/or replace one of the spherical bearings 1882, 1887, and 1888 with another of the spherical bearings 1882, 1887, and 1888 and reassemble the surface engagement section 1670 and the domed hand support section 1810 at the joint 1860. The embodiment of the system 1800 desirably may include a support strap 1850 to facilitate the user being able to grip the system 1800 while using the system 1800 as hand weights. The domed hand support section 1810 includes a wrist brace 1830 as previously described with reference to FIGS. 6 and 7.

Figure 19:
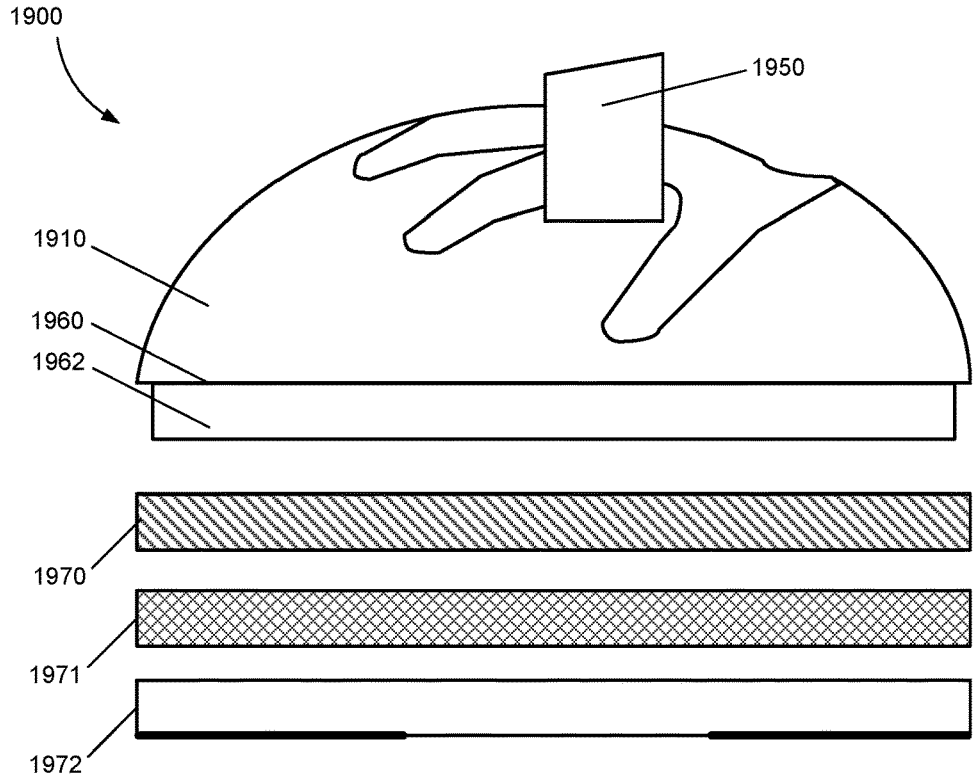
FIG. 19 is a side elevation view of an embodiment of a system including a hand support apparatus and interchangeable surface engagement sections according to an embodiment of the present disclosure.

FIG. 19 is a side elevation view of an embodiment of a system 1900 including an apparatus having interchangeable surface engagement sections 1970, 1971, and 1972 according to an embodiment of the present disclosure. The different interchangeable surface engagement sections 1970, 1971, and 1972 may have different weights so as to provide adjustable hand weights, as previously described with reference to FIG. 18. Inclusion of a support strap 1950 would support the use of the system 1900 as hand weights, as previously described. The domed hand support section 1810 does not include a wrist brace as previously described with reference to FIGS. 6 and 7, and as included in the apparatus of FIGS. 15, 16, and 18; however, it should be appreciated that a wrist brace could be included in any of the embodiments described herein.

The different interchangeable surface engagement sections 1970, 1971, and 1972 also may include different solid or open surface engagement section surfaces to facilitate sliding the system 1900 over a support surface (not shown in FIG. 19), resist sliding the system 1900 over a support surface, or to accommodate a spherical bearing (also not shown in FIG. 19) to permit rolling the system 1900 over the support surface. To change between the different interchangeable surface engagement sections 1970, 1971, and 1972, a user could use processes as described with reference to FIG. 15 to remove one of the interchangeable surface engagement sections 1970, 1971, and 1972 and attach another of the interchangeable surface engagement sections 1970, 1971, and 1972 with the domed hand support section 1910 at the joint 1960.

Figure 20:
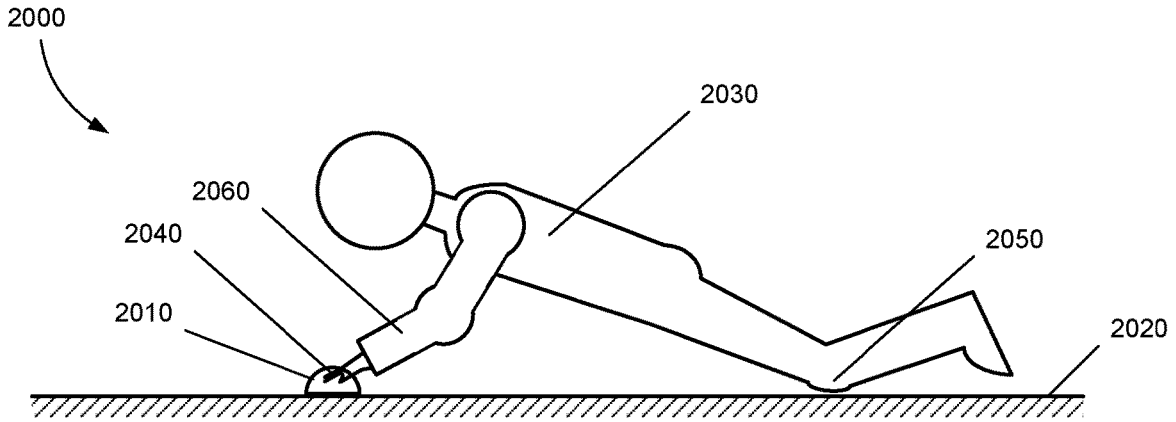
FIGS. 20-22 are side views of a user performing exercises using embodiments of an apparatus according to the present disclosure.
Figure 21:
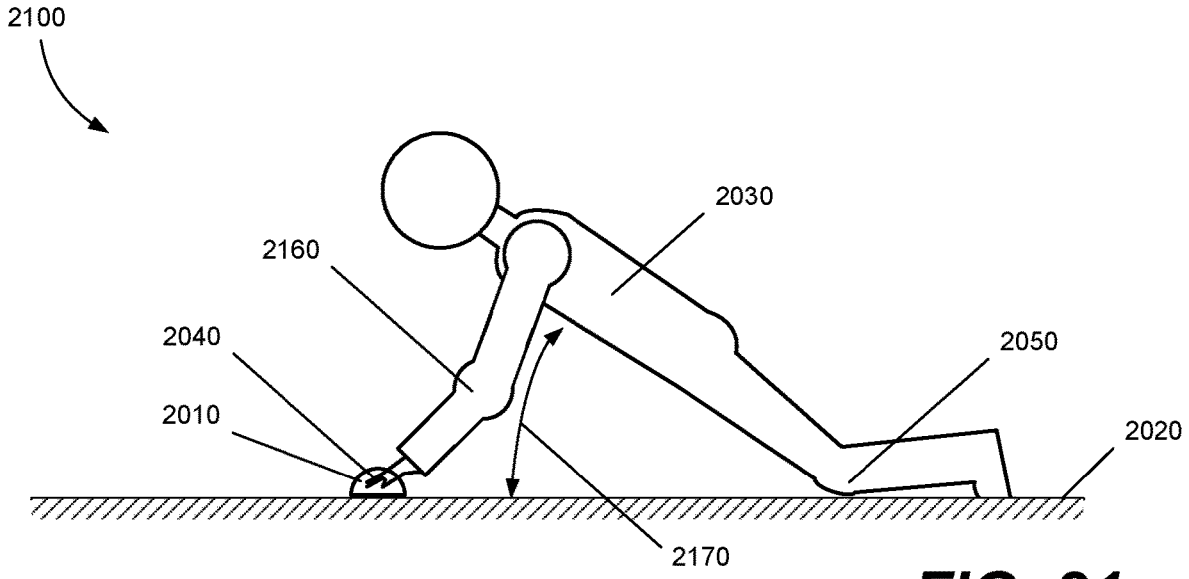
Figure 22:
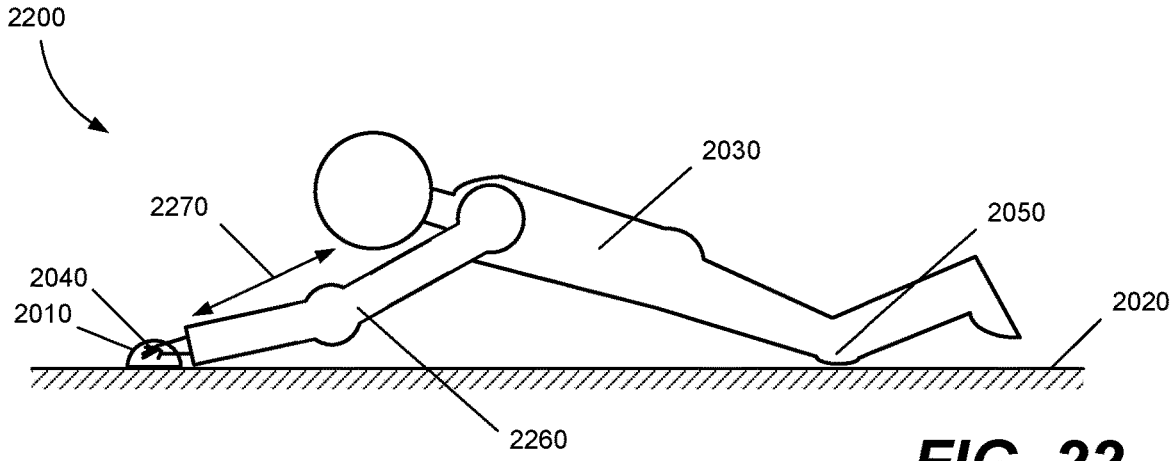

FIGS. 20-22 are side views of a user performing exercises using embodiments of an apparatus 2010 according to the present disclosure. In a position 2000 as shown in FIG. 20, a user engages his hand 2040 with the apparatus 2010 as previously described. In one implementation, resting his knees 2050 on a support surface 2020, the user holds his arms in retracted position 2060 so that his torso 2030 is low to the support surface 2020. In a position 2100 of FIG. 21, the user holds his arms in an extended position 2160, moving his torso 2030 up and down along directions 2170 away from and toward the support surface 2020. Please note that, because embodiments of the apparatus may be slideable, the user may move the apparatuses along the support surface 2020 in directions both across and transverse to the figure. Specifically, in a position 2200 as shown in FIG. 22, the user may extend his arms in an over-the-shoulder position 2260, pressing his arms forward and back along directions 2270, using the apparatus 2010 to facilitate sliding motion along the direction 2270.

Figure 23:
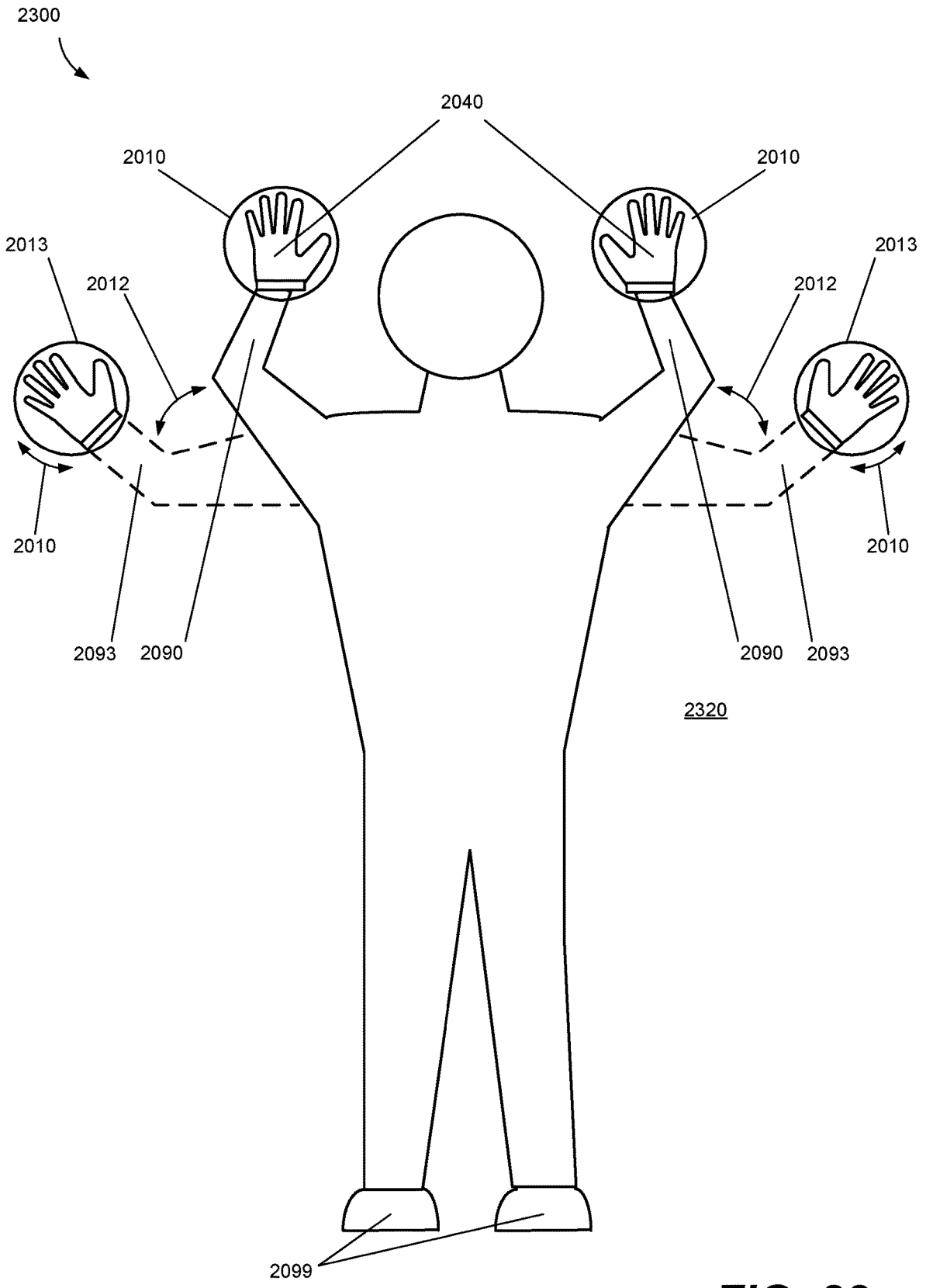
FIG. 23 is a top view of a user performing exercises using an embodiment of an apparatus according to the present disclosure.

FIG. 23 is a top view of a user in a position 2300 performing exercises using an embodiment of an apparatus according to the present disclosure. Because the apparatus 2010 enables a full range of movement across a plane defined by a support surface 2320, in contrast to ab wheels and fixed-track exercise devices, once the user has his hands 2040 placed within the apparatus 2010, the user can move his arms from a forward-and-out position 2090 to an outward position 2091, and other positions in between. As such, a user may perform exercises in a range of motion like a gymnast using suspended rings. In other words, a slideable apparatus enables a user to engage his or her hands with the recesses on the domed hand support apparatuses, rest at least a portion of his or her weight on the domed hand support apparatuses, and move the apparatuses over a generally planar support surface in each or both of two dimensions across the support surface 2320.

Figure 24:
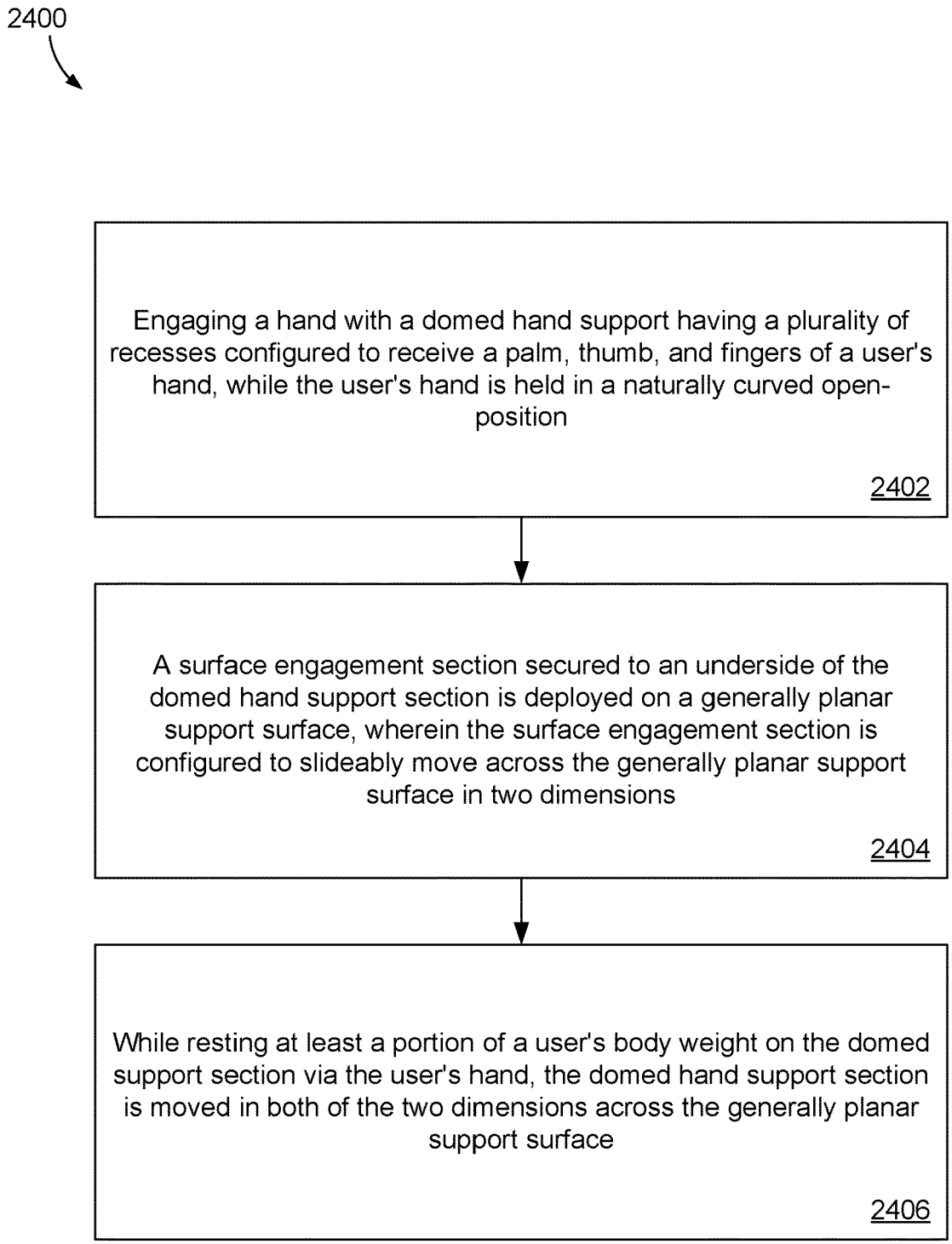
FIG. 24 is a flow diagram of a method of performing weight-bearing exercises on a support surface using embodiments of the apparatus according to the present disclosure.

FIG. 24 is a flow diagram of a method 2400 of performing a weight-bearing exercise using embodiments of the apparatus according to the present disclosure. At 2402, a hand is engaged with a domed hand support having a plurality of recesses configured to receive a palm, thumb, and fingers of a user's hand, while the user's hand is held in a naturally curved open-position. At 2404, a surface engagement section secured to an underside of the domed hand support section is deployed on a generally planar support surface, wherein the surface engagement section is configured to slideably move across the generally planar support surface in two dimensions. At 2406, while resting at least a portion of a user's body weight on the domed support section via the user's hand, the domed hand support section is moved in both of the two dimensions across the generally planar support surface.

Figure 25:
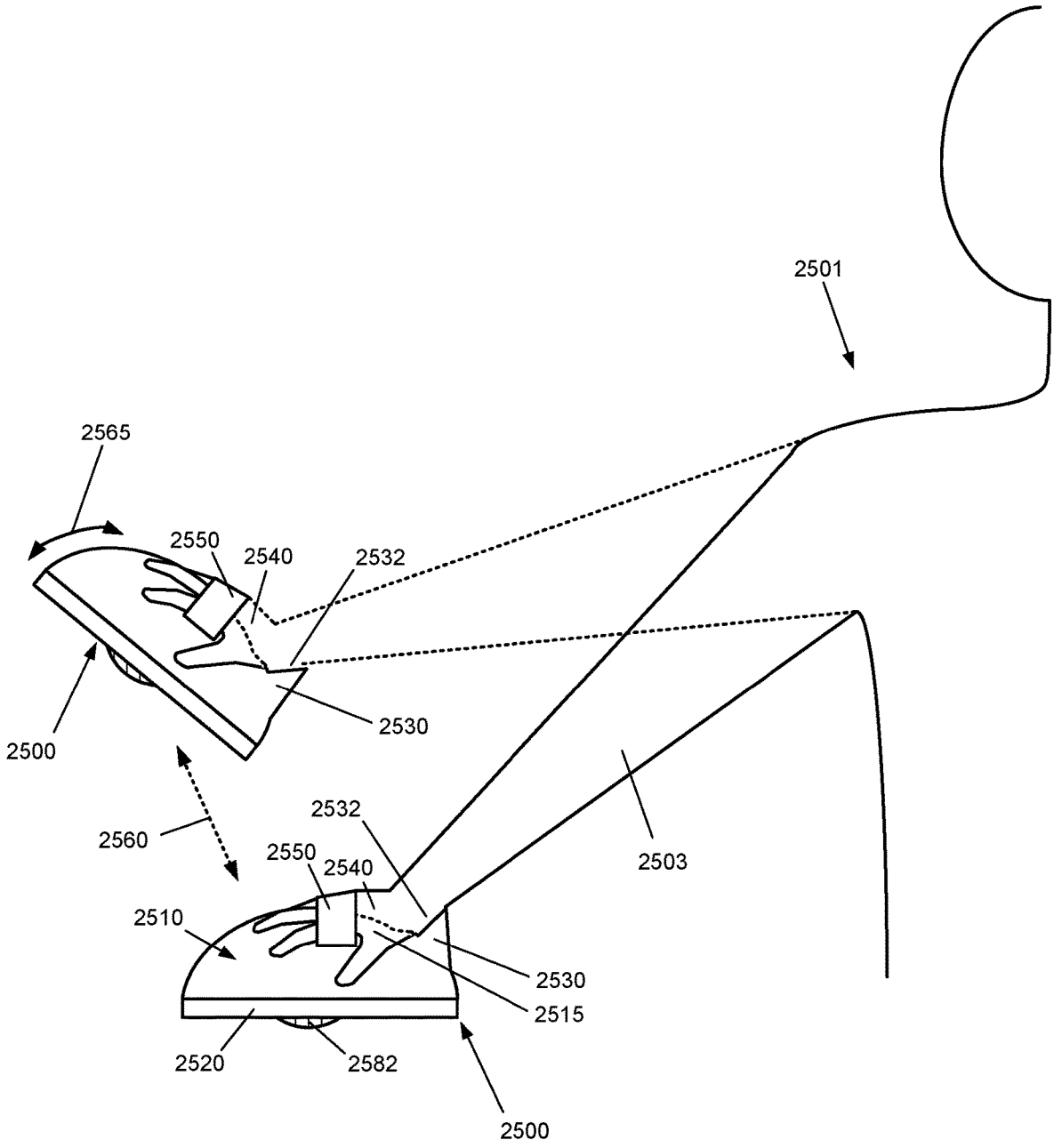
FIGS. 25 and 26 are side views of a user performing a lift exercise using embodiments of the apparatus according to the present disclosure.
Figure 26:
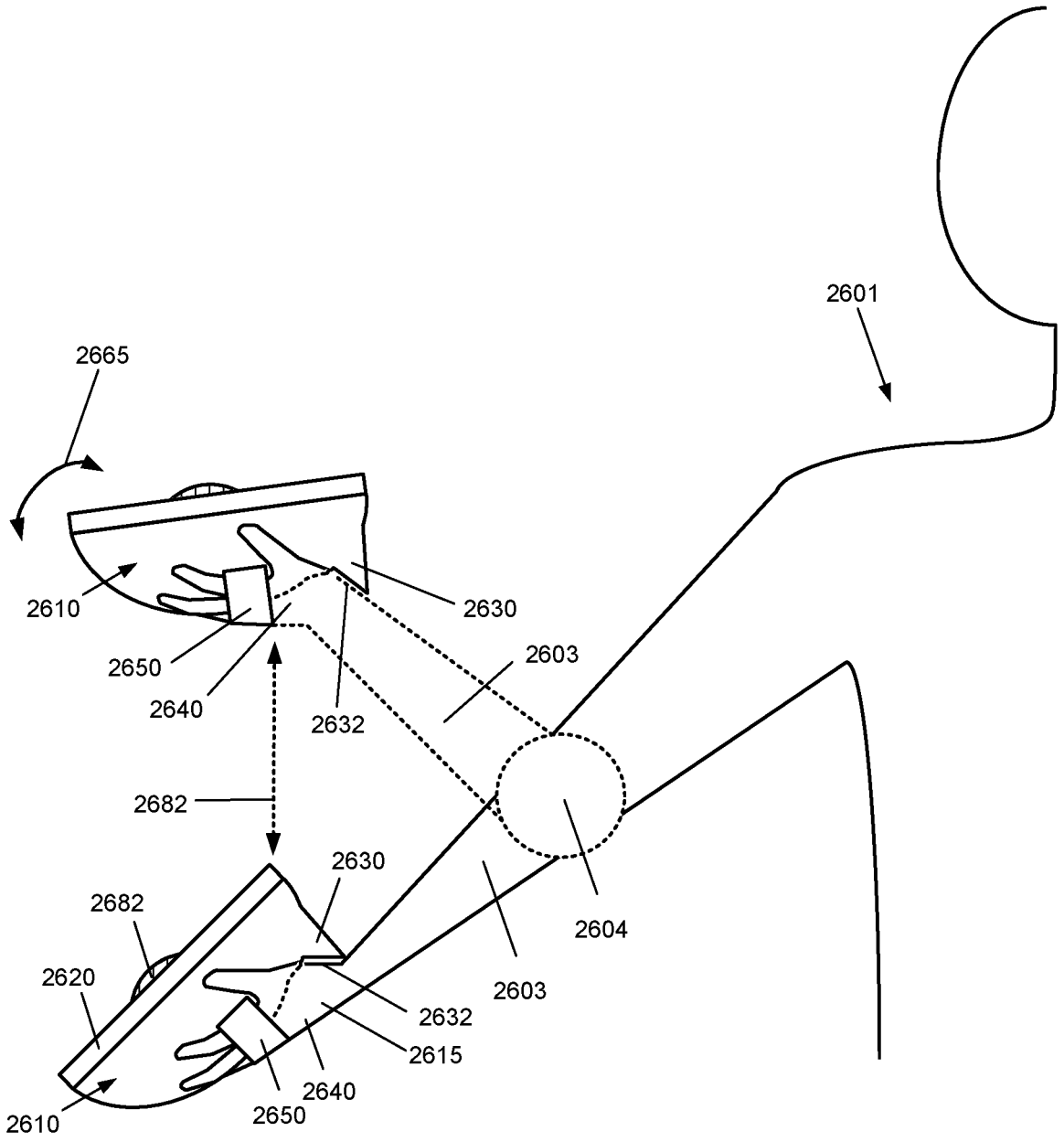

FIGS. 25 and 26 are side views of a user performing a lift exercise using embodiments of the apparatus according to the present disclosure. Specifically, FIG. 25 shows a user 2501 employing an apparatus 2500 to perform a lateral-type lifting exercise. The user 2501 engages his or her hand 2515 with the domed hand support section 2510 in the provided recesses as previously described throughout this application. In a particular embodiment, the domed hand support section 2510 supports a strap 2550 that engages a back 2540 of the user's hand, and a wrist brace 2530 engages an underside of the user's wrist 2532. As in performing other exercises, the domed hand support section 2510 supports the user's hand 2515 in a naturally-curved position throughout performance of the exercises; the strap 2550 and/or the wrist brace 2530 secure the domed hand support section 2510 to the user's hand 2515 throughout the exercise. As previously described with specific reference to FIGS. 18 and 19, the surface engagement section 2520 may be removable to enable interchange with differently-weighted surface engagement sections 2520 and/or to permit insertion or interchange of differently-weighted spherical bearings 2582 to change the level of resistance involved in the lift exercise depicted in FIG. 25.

When the user 2501 lifts his or her arm 2503 in an upward direction 2560, the user 2501 exercises various muscles in the user's arm 2503 or in other parts of the user's upper body. Weight of the apparatus 2500 provides resistance. As the apparatus 2500 is raised in the upward direction 2560, secured to the user's hand 2515 as previously described, the apparatus 2500 rotates along a curve 2565 corresponding with natural rotation of the user's hand 2515 during the movement of the arm 2503. The weight of the apparatus 2500 may be changed by interchanging differently-weighted surface engagement sections 2520 and/or differently-weighted spherical bearings 2582, thereby changing the resistance encountered by the user 2501 in raising the apparatus 2500.

FIG. 26 shows a user 2601 employing an apparatus 2600 to perform a different lifting exercise popularly termed a "curl." In contrast to the lifting exercise depicted in FIG. 25 in which the arm 2503 is lifted with the hand 2515 facing in a generally palm-down direction, the curl of FIG. 26 involves the user 2601 lifting the user's lower arm 2603 (i.e., the forearm below the elbow 2604) with the user's hand 2615 facing in a palm-up direction. The user 2601 engages his or her hand 2615 with the domed hand support section 2610 in the provided recesses as previously described throughout this application. In a particular embodiment, the domed hand support section 2610 supports a strap 2650 that engages a back 2640 of the user's hand, and a wrist brace 2630 engages an underside of the user's wrist 2632. As in performing other exercises, the domed hand support section 2610 supports the user's hand 2615 in a naturally-curved position throughout performance of the exercises; the strap 2650 and/or the wrist brace 2630 secure the domed hand support section 2610 to the user's hand 2615 throughout the exercise. As previously described with specific reference to FIGS. 18 and 19, the surface engagement section 2620 may be removable to enable interchange with differently-weighted surface engagement sections 2620 and/or to permit insertion or interchange of differently-weighted spherical bearings 2682 to change the level of resistance involved in the lift exercise depicted in FIG. 26.

When the user 2601 lifts his or her arm 2603 in an upward direction 2660, the user 2601 exercises various muscles in the user's arm 2603 or in other parts of the user's upper body. Weight of the apparatus 2600 provides resistance. As the apparatus 2600 is raised in the upward direction 2660, secured to the user's hand 2615 as previously described, the apparatus 2600 rotates along a curve 2665 corresponding with natural rotation of the user's hand 2615 during the movement of the arm 2603. The weight of the apparatus 2600 may be changed by interchanging differently-weighted surface engagement sections 2620 and/or differently-weighted spherical bearings 2682, thereby changing the resistance encountered by the user 2601 in raising the apparatus 2600.

Figure 27:
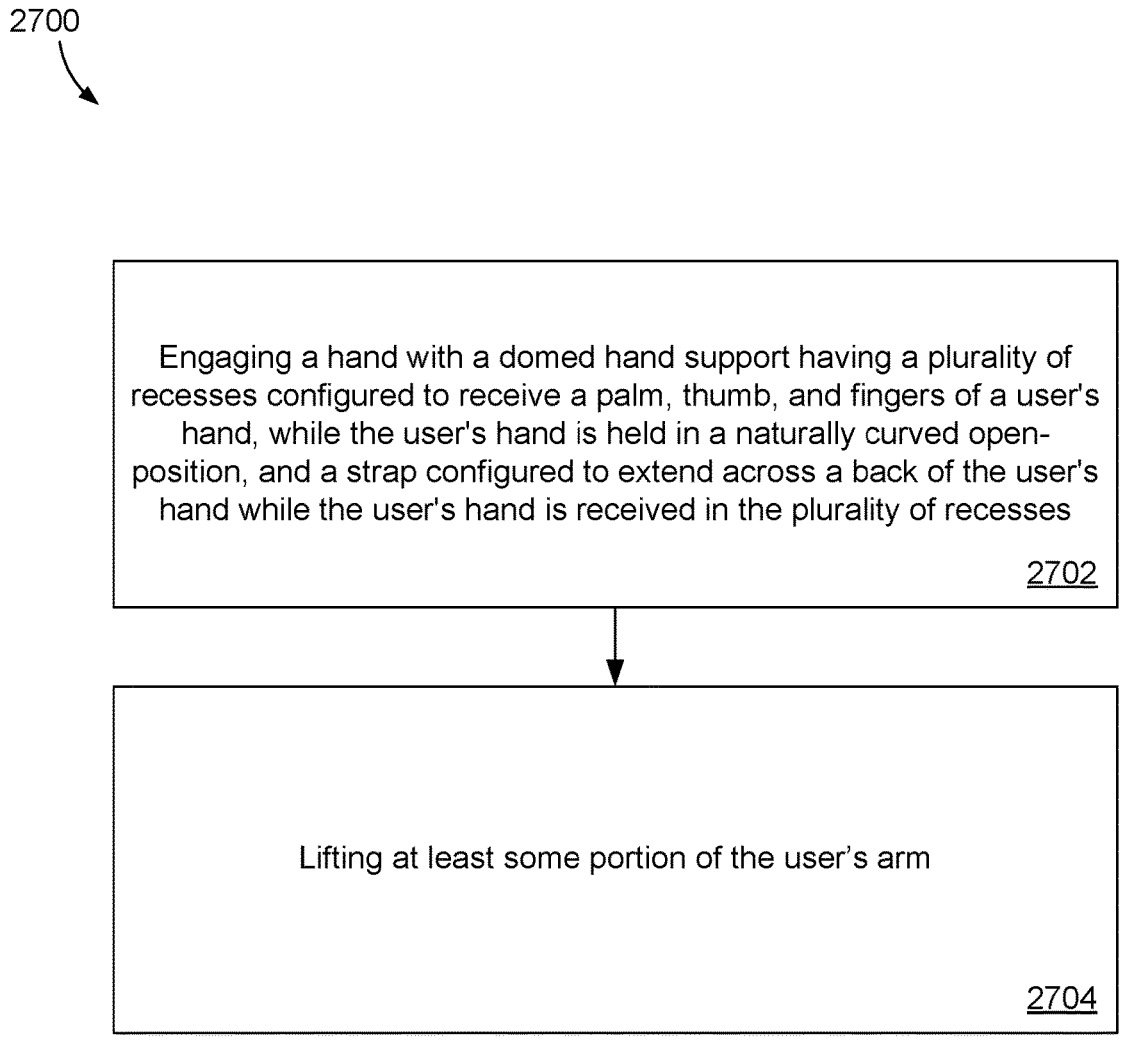
FIG. 27 is a flow diagram of a method of performing a lift exercise using embodiments of the apparatus according to the present disclosure.

FIG. 27 is a flow diagram 2700 of a method of performing a lift exercise using embodiments of the apparatus according to the present disclosure. The method may be adapted for performing any lift-type exercise, such as lateral lifts or curls as previously described with reference to FIGS. 25 and 26. In the flow diagram, at 2702, a user's hand is engaged with a domed hand support section having a plurality of recesses configured to receive a palm, thumb, and fingers of the user's hand, while the user's hand is held in a naturally curved open-position, and a strap configured to extend across a back of the user's hand while the user's hand is received in the plurality of recesses. At 2704, at least a portion of the user's arm is lifted. Examples of both steps are illustrated and described with reference to FIGS. 25 and 26.

While the disclosure has been has been set forth herein in reference to specific aspects, features and illustrative aspects, it will be appreciated that the utility of the disclosure is not thus limited, but rather extends to and encompasses numerous other variations, modifications and alternative aspects, as will suggest themselves to those of ordinary skill in the field of the present disclosure, based on the description herein. Any of various elements or features recited herein is contemplated for use with other features or elements disclosed herein, unless specified to the contrary. Correspondingly, the invention that may be hereinafter claimed is intended to be broadly construed and interpreted, as including all such variations, modifications and alternative aspects, within its spirit and scope.

What is claimed is:

1. An apparatus comprising:

a domed hand support section having an outer perimeter and defining a plurality of separate recesses each configured to receive and contain within an outer perimeter of the domed hand support an entirety of a palm, a thumb, and fingers of a hand of a user in an open position including:

a palm recess configured to receive the palm;

a thumb recess configured to receive the thumb; and a plurality of separate finger recesses, wherein each of the plurality of finger recesses is configured to receive at least one of the plurality of fingers separately from others of the plurality of fingers; and a surface engagement section secured to an underside of the domed hand support section and configured to engage a supporting surface, wherein in response to a force being applied to the hand in the open position with the palm, the thumb, and the plurality of fingers being placed in the plurality of separate recesses, the domed hand support separately supports the palm, the thumb, and the plurality of fingers away from edges of the perimeter of the domed hand support.

2. The apparatus of claim 1, wherein the plurality of separate finger recesses includes at least two separate recesses.

3. The apparatus of claim 2, wherein the plurality of separate finger recesses includes a separate recess for each of the plurality of fingers.

4. The apparatus of claim 1, wherein the plurality of separate recesses are configured to separately engage undersides of the palm, the thumb, and the plurality of fingers.

5. The apparatus of claim 1, further comprising a wrist brace extending from an outer edge of the palm recess, wherein the wrist brace is configured to engage an underside of a wrist of the user.

6. The apparatus of claim 1, further comprising a strap configured to extend across the palm recess to maintain the palm of within the pam recess.

7. The apparatus of claim 1, wherein the surface engagement section is comprised of a slip-resistant material.

8. The apparatus of claim 1, wherein the surface engagement section is comprised of a slidable material configured to facilitate sliding of the surface engagement section over a support surface.

9. The apparatus of claim 1, wherein the domed hand support section includes a recess configured to partially and rollably receive a spherical bearing, such that the spherical bearing partially extends outwardly from the domed hand support section and through the surface engagement section, such that the spherical bearing rollably supports the surface engagement section above the supporting surface.

10. An apparatus comprising:

a domed hand support section having an outer perimeter and defining a plurality of separate recesses each configured to receive and contain within an outer perimeter of the domed hand support an entirety of a palm, a thumb, and four fingers of a hand of a user in an open position including:

a palm recess configured to receive the palm;

a thumb recess configured to receive the thumb; and four separate finger recesses configured to separately receive each of the four fingers;

a wrist brace extending from an outer edge of the palm recess and configured to engage an underside of a wrist of the user; and a surface engagement section secured to an underside of the domed hand support section and configured to engage a supporting surface, wherein in response to a force being applied to the hand in the open position with the palm, the thumb, and the four fingers being placed in the plurality of separate recesses, the domed hand support separately supports the palm, the thumb, and the four fingers away from edges of the perimeter of the domed hand support.

11. The apparatus of claim 10, further comprising a strap configured to extend across the palm recess to maintain the palm of within the pam recess.

12. The apparatus of claim 10, wherein the surface engagement section is comprised of a slip-resistant material.

13. The apparatus of claim 10, wherein the surface engagement section is comprised of a slidable material configured to facilitate sliding of the surface engagement section over a support surface.

14. The apparatus of claim 10, wherein the domed hand support section includes a recess configured to partially and rollably receive a spherical bearing, such that the spherical bearing partially extends outwardly from the domed hand support section and through the surface engagement section, such that the spherical bearing rollably supports the surface engagement section above the supporting surface.

15. An apparatus comprising:

a domed hand support section having an outer perimeter and defining a plurality of separate recesses each configured to receive and contain within an outer perimeter of the domed hand support an entirety of a palm, a thumb, and fingers of a hand of a user in an open position including:

a palm recess configured to receive the palm;

a thumb recess configured to receive the thumb; and a plurality of separate finger recesses, wherein each of the plurality of finger recesses is configured to receive at least one of the plurality of fingers separately from others of the plurality of fingers; and an interchangeable surface engagement section removably securable to an underside of the domed hand support section and configured to engage a supporting surface, wherein the interchangeable surface engagement section includes an engagement section chosen from one of:

a slip-resistant surface engagement section;

a slidable surface engagement section; and a rollable surface engagement section including at least one spherical bearing partially extending outwardly from a surface of the surface engagement section, wherein in response to a force being applied to the hand in the open position with the palm, the thumb, and the plurality of fingers being placed in the plurality of separate recesses, the domed hand support separately supports the palm, the thumb, and the plurality of fingers away from edges of the perimeter of the domed hand support.

16. The apparatus of claim 15, wherein the plurality of separate finger recesses includes at least two separate recesses.

17. The apparatus of claim 15, wherein the plurality of separate finger recesses includes a separate recess for each of the plurality of fingers.

18. The apparatus of claim 15, wherein the plurality of separate recesses are configured to separately engage undersides of the palm, the thumb, and the plurality of fingers.

19. The apparatus of claim 15, further comprising a wrist brace extending from an outer edge of the palm recess, wherein the wrist brace is configured to engage an underside of a wrist of the user.

20. The apparatus of claim 15, further comprising a strap configured to extend across the palm recess to maintain the palm of within the pam recess.

* * * * *